US006659056B2

(12) United States Patent
Sweetland

(10) Patent No.: US 6,659,056 B2
(45) Date of Patent: Dec. 9, 2003

(54) VALVE TRAIN WITH A SINGLE CAMSHAFT

(75) Inventor: Roger D. Sweetland, Storrington (GB)

(73) Assignee: Cummins Inc.

( * ) Notice: Subject to any disclaimer, the term of this patent is extended or adjusted under 35 U.S.C. 154(b) by 0 days.

(21) Appl. No.: 10/210,268

(22) Filed: Aug. 1, 2002

(65) Prior Publication Data

US 2002/0179028 A1 Dec. 5, 2002

Related U.S. Application Data

(63) Continuation of application No. PCT/US01/03318, filed on Feb. 1, 2001.

(51) Int. Cl.[7] ..... F01L 1/26

(52) U.S. Cl. ..... 123/90.23; 123/90.27; 123/90.4; 123/193.5

(58) Field of Search ..... 123/193.5, 432, 123/315, 302, 90.39, 90.4, 90.44, 90.27, 90.16, 90.22, 90.23

(56) References Cited

U.S. PATENT DOCUMENTS

| | | | | | |
|---|---|---|---|---|---|
| 1,172,358 | A | | 2/1916 | Herkt | |
| 1,659,528 | A | | 2/1928 | Hosterman | |
| 3,942,490 | A | | 3/1976 | Scott | |
| 4,561,391 | A | | 12/1985 | Simko | |
| 4,624,222 | A | | 11/1986 | Yoshikawa | |
| 4,714,059 | A | | 12/1987 | Masuda et al. | |
| 4,741,301 | A | | 5/1988 | Patterson | |
| 4,773,361 | A | | 9/1988 | Toki et al. | |
| 4,791,893 | A | | 12/1988 | Muranaka et al. | |
| 4,825,822 | A | | 5/1989 | Muranaka et al. | |
| 4,913,104 | A | | 4/1990 | Mills | |
| 4,951,622 | A | | 8/1990 | Takahashi et al. | |
| 5,038,732 | A | | 8/1991 | Matayoshi et al. | |
| 5,207,210 | A | | 5/1993 | Yamagata et al. | |
| 5,303,680 | A | * | 4/1994 | Nielsen | 123/90.22 |
| 5,347,964 | A | | 9/1994 | Reguiero | |
| 5,410,995 | A | * | 5/1995 | Bentz et al. | 123/90.22 |
| 5,445,117 | A | | 8/1995 | Mendler | |
| 5,626,110 | A | | 5/1997 | Regueiro | |
| 5,638,783 | A | | 6/1997 | Regueiro | |
| 5,669,344 | A | | 9/1997 | Regueiro | |
| 5,673,660 | A | | 10/1997 | Regueiro | |
| 5,682,849 | A | * | 11/1997 | Regueiro | 123/90.22 |
| 5,806,477 | A | * | 9/1998 | Regueiro | 123/90.22 |
| 6,354,254 | B1 | * | 3/2002 | Usko | 123/90.16 |
| 6,390,046 | B1 | * | 5/2002 | Sweetland | 123/90.4 |

* cited by examiner

*Primary Examiner*—Thomas Denion
*Assistant Examiner*—Ching Chang
(74) *Attorney, Agent, or Firm*—Woodward, Emhardt, Moriarty, McNett & Henry LLP

(57) ABSTRACT

A valvetrain with a single camshaft is disclosed. The valvetrain has one or more intake valves, and one or more exhaust valves per cylinder of an engine block. The valvetrain comprises a cylinder head. The valve head of each intake valve is removably seated within a corresponding intake valve seat of the cylinder head, and the stem of each intake valve is movably positioned within the cylinder head. The valve head of each exhaust valve is removably seated within a corresponding exhaust valve seat of the cylinder head, and the stem of each exhaust valve is movably positioned with the cylinder head. For each cylinder, an intake crosshead and an exhaust crosshead are pivotally mounted upon the cylinder head. Each intake crosshead is operatively mounted upon the stem top of a corresponding intake valve. Each exhaust crosshead is operatively mounted upon the stem top of a corresponding exhaust valve. For each cylinder, an intake rocker arm and an exhaust rocker arm are pivotally coupled to the cylinder head. Each intake rocker arm operatively abuts a corresponding intake crosshead. Each exhaust rocker arm operatively abuts a corresponding exhaust crosshead. The single camshaft is rotatably mounted to the cylinder head, and operatively abuts the rocker arms. As the camshaft cyclically rotates, the rockers arm and the crossheads undulatedly pivot about the cylinder head causing a undulated seating and unseating of the intake valve(s) and the exhaust valve(s) within the respective intake valve seat(s) and exhaust valve seat(s).

9 Claims, 28 Drawing Sheets

VALVE TRAIN WITH A SINGLE CAMSHAFT

The present application is a continuation of International Application No. PCT/US01/03318 filed on Feb. 1, 2001. PCT/US01/03318 claims priority to U.S. application Ser. No. 09/494,856 filed Feb. 1, 2000, now U.S. Pat. No. 6,390,046. Applications PCT/US01/03318 and Ser. No. 09/494,856 are incorporated herein by reference.

TECHNICAL FIELD OF THE INVENTION

The present invention generally relates to an internal combustion engine including a plurality of cylinders, at least one intake valve per cylinder and at least one exhaust valve per cylinder. The present invention specifically relates to an internal combustion engine further including a valve train with a single camshaft operatively opening and closing the intake and exhaust valves.

BACKGROUND OF THE INVENTION

An internal combustion engine includes an engine block and a cylinder head. The engine block includes one or more cylinders, each cylinder having a piston movably disposed therein. The cylinder head is mounted upon the engine block to form a combustion chamber for each cylinder. The perimeter of a combustion chamber is defined by a bottom surface of the cylinder head, an upper portion of a cylinder, and a crown of the piston disposed within the cylinder. The cylinder head includes one or more intake passageways leading into the combustion chamber, and one or more exhaust passageways leading out of the combustion chamber. Each intake and exhaust passageway is constructed with a valve seat adjacent the combustion chamber and the construction includes a valve for cooperation with a corresponding valve seat. To obtain optimal engine performance, each combustion chamber is designed to be as compact as possible in view of the overall performance requirements for the engine and dimensional specifications for the engine block and the cylinder head. As such, the intake valve seats and the exhaust valve seats are typically arranged in close proximity with a bore disposed between the valves seats for either a spark plug or a fuel injector.

For an internal combustion engine which includes a valve train having dual overhead camshafts and associated cam followers mounted upon the cylinder head, the lateral width of the cylinder head must be sufficiently dimensioned to accommodate the dual camshafts, the cam followers, and either a spark plug or a fuel injector. However, the required lateral width for the cylinder head configured in this manner may exceed the dimensional specifications for the overall width of an engine, particularly if the engine is configured in a conventional "V" arrangement. Moreover, a close proximity arrangement of the intake valve seats and the exhaust valve seats normally necessitates an angular orientation of the valve heads of the intake valves and the exhaust valves toward a center longitudinal axis of the associated combustion chamber. As a result, the distance between the stem tops of the intake valves and the exhaust valves is expanded causing the distance between the two camshafts as mounted on the cylinder head to be expanded. Consequently, the lateral width of the cylinder head must be increased to support the two camshafts. This increase may cause the lateral width of an otherwise acceptable cylinder head to exceed the desired dimensional specifications.

Additionally, there are further disadvantages associated with a valve train having dual overhead camshafts and associated cam followers. First, any friction loss by the two camshafts and associated cam followers as the two camshafts are rotating may increase fuel consumption. Second, duel overhead camshafts and associated cam followers may not be economically feasible. Third, the minimization of manufacturing imperfections can be costly. Specifically, a cam follower has a planar or convex surface for engaging a cam of a camshaft. The cam follower is machined upon a rocker arm that is pivotally mounted onto the cylinder head and operatively mounted upon a valve. To achieve optimal engine performance, it is necessary that manufacturing imperfections are minimized for both the cam follower and the rocker arm. However, the overall cost for the valve train must be increased to attain a minimization of manufacturing imperfections.

Moreover, cylinder heads as known in the art for valve trains having dual overhead camshafts are not suitable for diesel engines. For each intake valve, known cylinder heads include a fluid intake passage extending from an intake port to an intake valve seat. Generally, the fluid intake passage has an arcuate configuration. As a result, air flowing into the intake port through the fluid intake passage will uniformly circulate along an open intake valve as the air enters into the corresponding combustion chamber. Consequently, the air tumbles within the combustion chamber. A tumbling of the air within the combustion chamber facilitates optimal engine performance for a gas engine. However, such tumbling would hinder optimal engine performance for a diesel engine.

In view of the foregoing issues, there is a need for minimizing the lateral width of a cylinder head while designing combustion chambers that are suitably compact to render optimal engine performance. There is also a need for improving upon valve trains having dual overhead camshafts, particularly for diesel engines. The present invention satisfies these needs in a novel and unobvious manner.

SUMMARY OF THE INVENTION

According to one embodiment of the present invention, a valve train with a single camshaft is disclosed. The single camshaft operatively opens and closes one or more intake valves and one or more exhaust valves. In one form of the present invention, a valve train is disclosed, comprising a cylinder head, one or more valves (intake or exhaust) movably positioned within the cylinder head, a crosshead pivotally adjoined to the cylinder head and operatively adjoined to each valve (intake or exhaust), a rocker arm pivotally adjoined to the cylinder head and operatively adjoined to the crosshead, and a camshaft rotatably adjoined to the cylinder head and operatively adjoined to the rocker arm. When the camshaft is rotated, the rocker arm and the crosshead pivot about the cylinder head to thereby move the valve(s) (intake or exhaust) within the cylinder head.

In a related embodiment of the present invention, a valve train is disclosed, comprising a cylinder head, one or more intake valves movably positioned within the cylinder head, one or more exhaust valves movably positioned within the cylinder head, an intake crosshead pivotally adjoined to the cylinder head and operatively adjoined to each intake valve, an exhaust crosshead pivotally adjoined to the cylinder head and operatively adjoined to each exhaust valve, an intake rocker arm pivotally adjoined to the cylinder head and operatively adjoined to the intake crosshead, an exhaust rocker arm pivotally adjoined to the cylinder head and operatively adjoined to the exhaust crosshead, and a camshaft rotatably adjoined to the cylinder head and operatively adjoined to both the intake rocker arm and exhaust rocker arm. When the camshaft is rotated, the intake rocker arm and the intake crosshead pivot about the cylinder head to thereby move the intake valve(s) within the cylinder head, and the exhaust rocker arm and the exhaust crosshead pivot about the cylinder head to thereby move the exhaust valve(s) within the cylinder head.

In yet another related embodiment of the present invention, a valve train is disclosed, comprising a cylinder head a valve train is disclosed, comprising a cylinder head including one ore more valve seats. The valve train further comprises a valve (intake or exhaust) removably seated within a corresponding valve seat, a crosshead pivotally adjoined to the cylinder head and operatively adjoined to the valves (intake or exhaust), a rocker arm pivotally adjoined to the cylinder head and operatively adjoined to the crosshead, and a camshaft rotatably adjoined to the cylinder head and operatively adjoined to the rocker arm. As the camshaft cyclically rotates, the rocker arm and the crosshead undulatedly pivot about the cylinder head to thereby undulatedly seat and unseat the valves (intake or exhaust) within the valve seat(s).

In yet another related embodiment of the present invention, a valve train is disclosed, comprising a cylinder head including one or more intake valve seats and one or more exhaust valve seats. The valve train further comprises an intake valve removably seated within a corresponding intake valve seat, an exhaust valve removably seated within a corresponding exhaust valve seat, an intake crosshead pivotally adjoined to the cylinder head and operatively adjoined to the intake valve(s), an exhaust crosshead pivotally adjoined to the cylinder head and operatively adjoined to the exhaust valve(s), an intake rocker arm pivotally adjoined to the cylinder head and operatively adjoined to the intake crosshead, an exhaust rocker arm pivotally adjoined to the cylinder head and operatively adjoined to the exhaust crosshead, and a camshaft rotatably adjoined to the cylinder head and operatively adjoined to both rocker arms. As the camshaft cyclically rotates, the intake rocker arm and the intake crosshead undulatedly pivot about the cylinder head to thereby undulatedly seat and unseat the intake valves within the intake valve seat(s), and the exhaust rocker arm and the exhaust crosshead undulatedly pivot about the cylinder head to thereby undulatedly seat and unseat the exhaust valve(s) within the exhaust valve seat(s).

One object of the present invention is to provide an improved valve train having a single camshaft arranged on a cylinder head to operatively open and close intake valves and/or exhaust valves.

Related objects and advantages of the present invention will be apparent from the following description.

DESCRIPTION OF THE PREFERRED EMBODIMENT

Figure 1A:
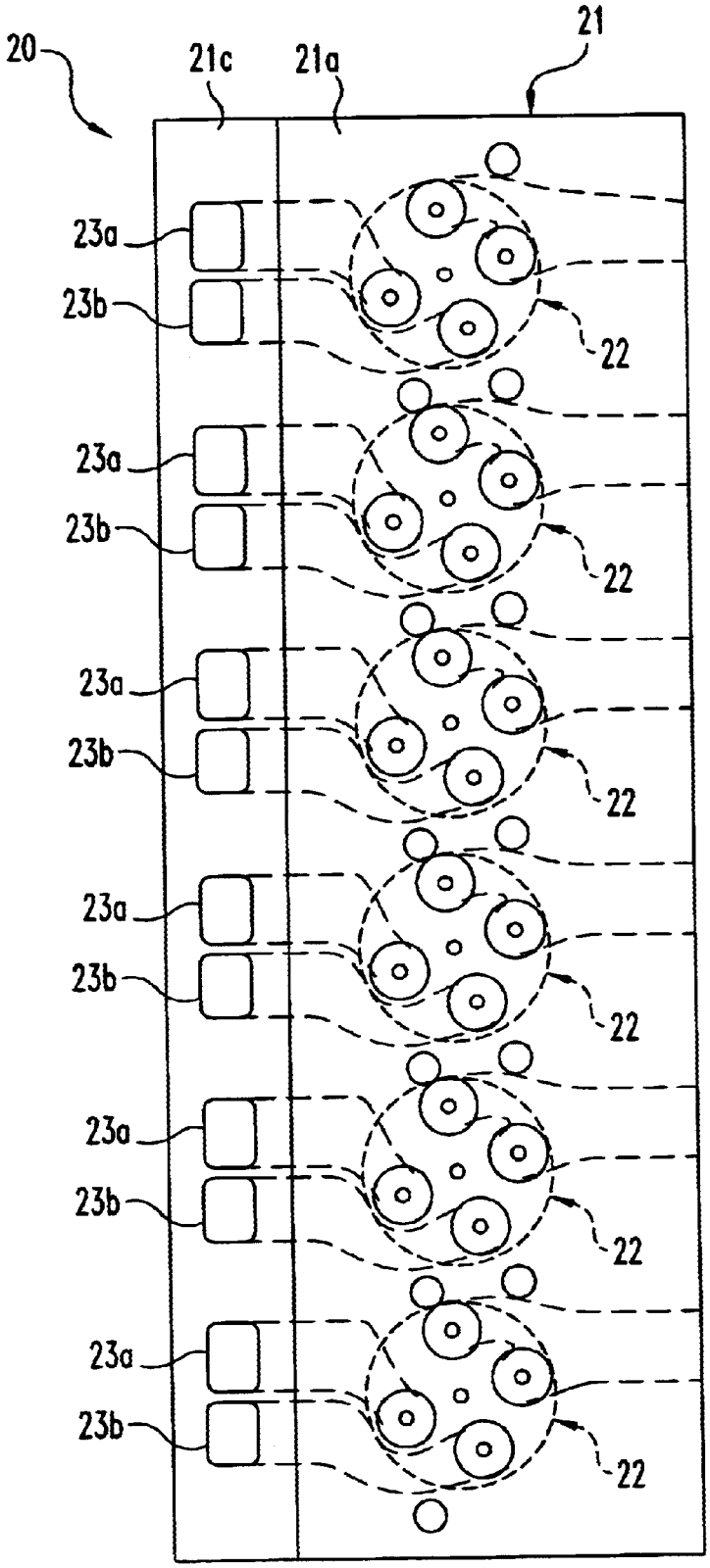
FIG. 1A is a diagrammatic top plan view of a first embodiment of a cylinder head in accordance with the present invention.

For the purposes of promoting an understanding of the principles of the present invention, reference will now be made to the embodiments illustrated in the drawings and specific language will be used to describe the same. It will nevertheless be understood that no limitation of the scope of the present invention is thereby intended, such alterations and further modifications in the illustrated device, and such further applications of the principles of the present invention as illustrated therein being contemplated as would normally occur to one skilled in the art to which the present invention relates.

The present invention relates to a valve train with a single camshaft. Additional primary components of the valve train include a cylinder head, one or more valves (intake and/or exhaust), one or more crossheads, and one or more rocker arms. For purposes of the present invention, the term adjoined as used herein is defined as a unitary fabrication, an affixation, a coupling, a mounting, an engagement, or an abutment of two or more components of the valve train. The valves are movably positioned within the cylinder head. Each crosshead is pivotally adjoined to the cylinder head and operatively adjoined to one or more valves. Each rocker arm is pivotally adjoined to the cylinder head and operatively adjoined to a crosshead. The camshaft is rotatably adjoined to the cylinder head and operatively adjoined to each rocker arm. A rotation of the camshaft pivots the rocker arm(s) and the crosshead(s) about the cylinder head causing the valves to move within the cylinder head. The present invention contemplates that each component of the valve train is made from a material or combination of materials as known in the art that are suitable for the operability of the valve train over an operative temperature range for an internal combustion engine.

The illustrated embodiments of a cylinder head, a crosshead, and a rocker arm are in accordance with the present invention and are therefore independently shown in FIGS. 1A–4C, FIGS. 5A–10C, and FIGS. 11A–12B, respectively. The illustrated embodiments of a valve and a cam shaft are in accordance with the known art, and are therefore shown in an assembled valve train of the present invention as shown in FIGS. 13A–16C. The present invention does not contemplate any limitations as to the geometric configurations and physical dimensions of any component of the valve train. Consequently, the illustrated embodiments of the primary components of the valve train are given solely for purposes of describing the best mode of the present invention, and are not meant to be limiting to the scope of the claims in any way. The illustrated embodiments of a cylinder head are intended to be mounted upon an engine block having six (6) cylinders with a pair of intake valves and a pair of exhaust valves per cylinder, and the illustrated embodiments of a crosshead are intended to be operatively adjoined to a pair of valves (intake or exhaust). However, it is to be appreciated and understood that a cylinder head in accordance with the present invention can be configured to be mounted upon an engine block having any number of cylinders with at least one intake valve per cylinder and at least one exhaust valve per cylinder. It is to be further appreciated and understood that a crosshead in accordance with the present invention can be operatively adjoined to one or more valves (intake or exhaust), and can be operatively adjoined to an intake valve and an exhaust valve. For the preferred embodiments of crossheads as illustrated herein, it is to be appreciated that each illustrated crosshead includes an arm for each valve operatively adjoined to the illustrated crosshead. Accordingly, the present invention contemplates decreasing or increasing the number of arms of an illustrated crosshead as a function of the number of valves to be operatively adjoined to the illustrated crosshead.

Figure 1C:
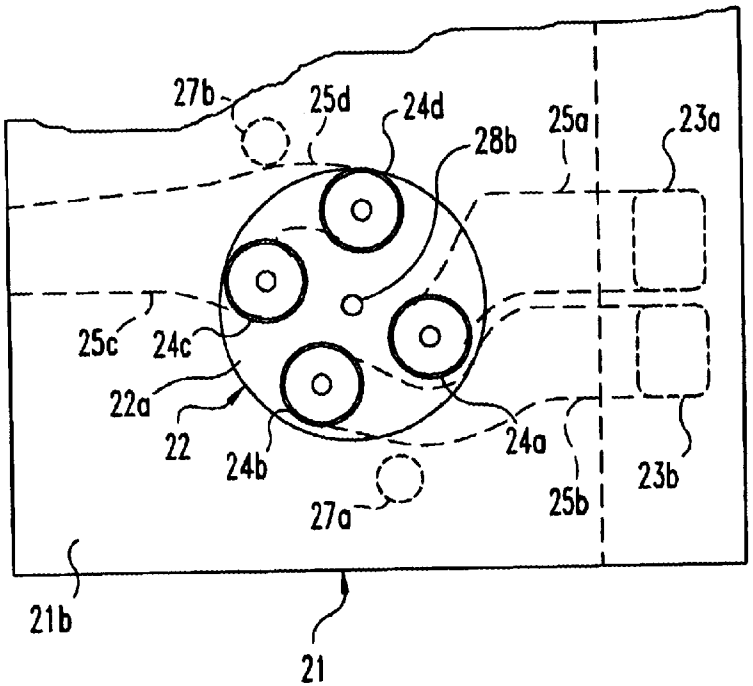
FIG. 1C is an enlarged, partial bottom plan view of the FIG. 1A cylinder head.
Figure 1B:
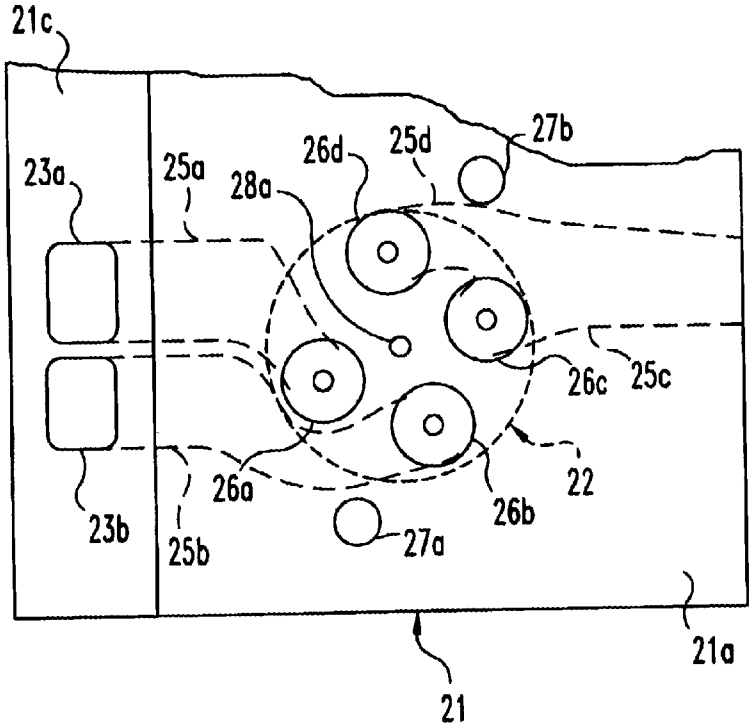
FIG. 1B is an enlarged, partial top plan view of the FIG. 1A cylinder head.

Referring to FIGS. 1A–1C, a first embodiment cylinder head 20 is shown. Cylinder head 20 includes a body 21, and one or more combustion chamber covers 22. Preferably, cylinder head 20 has six (6) combustion chamber covers 22 as shown. Combustion chamber covers 22 are recessed within and adjoined to a bottom surface 21*b* of body 21. Preferably, body 21 and combustion chamber covers 22 are fabricated as a unitary member. Combustion chamber covers 22 are positioned along bottom surface 21*b* whereby each combustion chamber cover 22 will be vertically aligned with a corresponding cylinder of an engine block when body 21 is adjoined to the engine block to thereby define combustion chambers between combustion chamber covers 22, the cylinders, and the pistons within the cylinders. Body 21 includes a pair of intake ports 23*a* and 23*b* for each combustion chamber cover 22. Intake ports 23*a* and 23*b* are disposed within a left side surface 21*c* of body 21. Left side surface 21*c* of body 21 is upwardly oriented to enhance fluid communication between intake ports 23*a* and 23*b* and an intake manifold (not shown) that is adjoined to body 21. Body 21 further includes an exhaust port (not shown) for each combustion chamber cover 22. The exhaust ports are disposed within a right side surface (not shown) of body 21.

With continued reference to FIGS. 1B and 1C, each combustion chamber cover 22 includes a pair of intake valve seats 24*a* and 24*b*, and a pair of exhaust valve seats 24*c* and 24*d*. The intake valve seats 24*a* and 24*b* and the exhaust valve seats 24*c* and 24*d* are recessed within a bottom surface 22*a* of each combustion chamber cover 22. Preferably, bottom surface 21*b* of body 21 and bottom surface 22*a* of combustion chamber covers 22 are planar and coplanar. For each combustion chamber cover 22, body 21 includes an intake fluid passage 25*a* extending from intake port 23*a* to intake valve seat 24*a* and an intake fluid passage 25*b* extending from intake port 23*b* to intake valve seat 24*b*. Alternatively, intake port 23*b* can be omitted from body 21 and intake fluid passages 25*a* and 25*b* can both extend from intake port 23*a* to intake valve seats 24*a* and 24*b*, respectively. Also for each combustion chamber cover 22, body 21 includes an exhaust fluid passage 25*c* extending from exhaust valve seat 24*c* to the corresponding exhaust port, and an exhaust fluid passage 25*d* extending from exhaust valve seat 24*d* to the corresponding exhaust port. Alternatively, for each combustion chamber cover 22, body 21 can further include a second exhaust port disposed within the right side surface of body 21 with exhaust fluid passages 25*d* extending from exhaust valve seats 24*d* to the second exhaust ports.

Preferably, intake fluid passages 25*a* and 25*b* have curvilinear configurations with two opposing arcs therein to facilitate a swirling of air introduced into a corresponding combustion chamber. The curvilinear configuration intake fluid passage 25*a* is best illustrated in FIG. 13C. Referring to FIG. 13C, a forward arc segment 25*e* of intake fluid passage 25*a* diagonally extends from intake port 23*a* in a substantially downward direction and then bends toward a substantially horizontal direction. A rearward arc segment 25*f* of intake fluid passage 25*a* extends from forward arc segment 25*e* in a substantially horizontal direction and then bends in a substantially downward direction toward intake valve seat 24*a*. As a result, a substantial portion of any air flowing into intake port 23*a* through intake fluid passage 25*a* will circulate along a portion of an open intake valve 161*a* as the air enters into the corresponding combustion chamber. Consequently, the air swirls within the combustion chamber. To enhance the swirling of the air within the combustion chambers, intake valve seats 24*a* and 24*b* are positioned within combustion chamber covers 22 such that air entering the combustion chambers through intake valve seats 24*a* swirls in substantially the same direction as the air entering the combustion chambers through intake valve seats 24*b*.

Referring again to FIGS. 1B and 1C, for each combustion chamber cover 22, body 21 additionally includes a pair of intake bores 26*a* and 26*b* and a pair of exhaust bores 26*c* and 26*d* disposed therein. Each intake bore 26*a* extends from top surface 21*a* of body 21 to a corresponding intake fluid passage 25*a*. Each intake bore 26*b* extends from top surface 21*a* of body 21 to a corresponding intake fluid passage 25*b*. Each exhaust bore 26*c* extends from top surface 21*a* of body 21 to a corresponding exhaust fluid passage 25*c*. Each exhaust bore 26*d* extends from top surface 21*a* of body 21 to a corresponding exhaust fluid passage 25*d*. Body 21 also includes an intake lash adjuster seat 27*a*, and an exhaust lash adjuster seat 27*b* for each combustion chamber cover 22. Each intake lash adjuster seat 27*a* is disposed within top surface 21*a* of body 21 and is adjacent corresponding intake bores 26*a* and 26*b*. For each combustion chamber cover 22, intake bores 26*a* and 26*b* and intake lash adjuster seat 27*a* are positioned to support a mounting upon body 21 of an intake crosshead 70 of an intake valve assembly 160 as best illustrated in FIG. 13B. Each exhaust lash adjuster seat 27*b* is disposed within top surface 21*b* of cylinder head 21 and is adjacent corresponding exhaust bores 26*c* and 26*d*. For each combustion chamber cover 22, exhaust bores 26*c* and 26*d* and exhaust lash adjuster seat 27*b* are positioned to support a mounting upon body 21 of an exhaust crosshead 70 of an exhaust valve assembly 170 as best illustrated in FIG. 13B. Body 21 further includes a fuel injector bore 28*a* for each combustion chamber cover 22, and combustion chamber covers 22 include a fuel injector bore 28*b* that is vertically aligned with a corresponding fuel injector bore 28*a*.

Figure 2A:
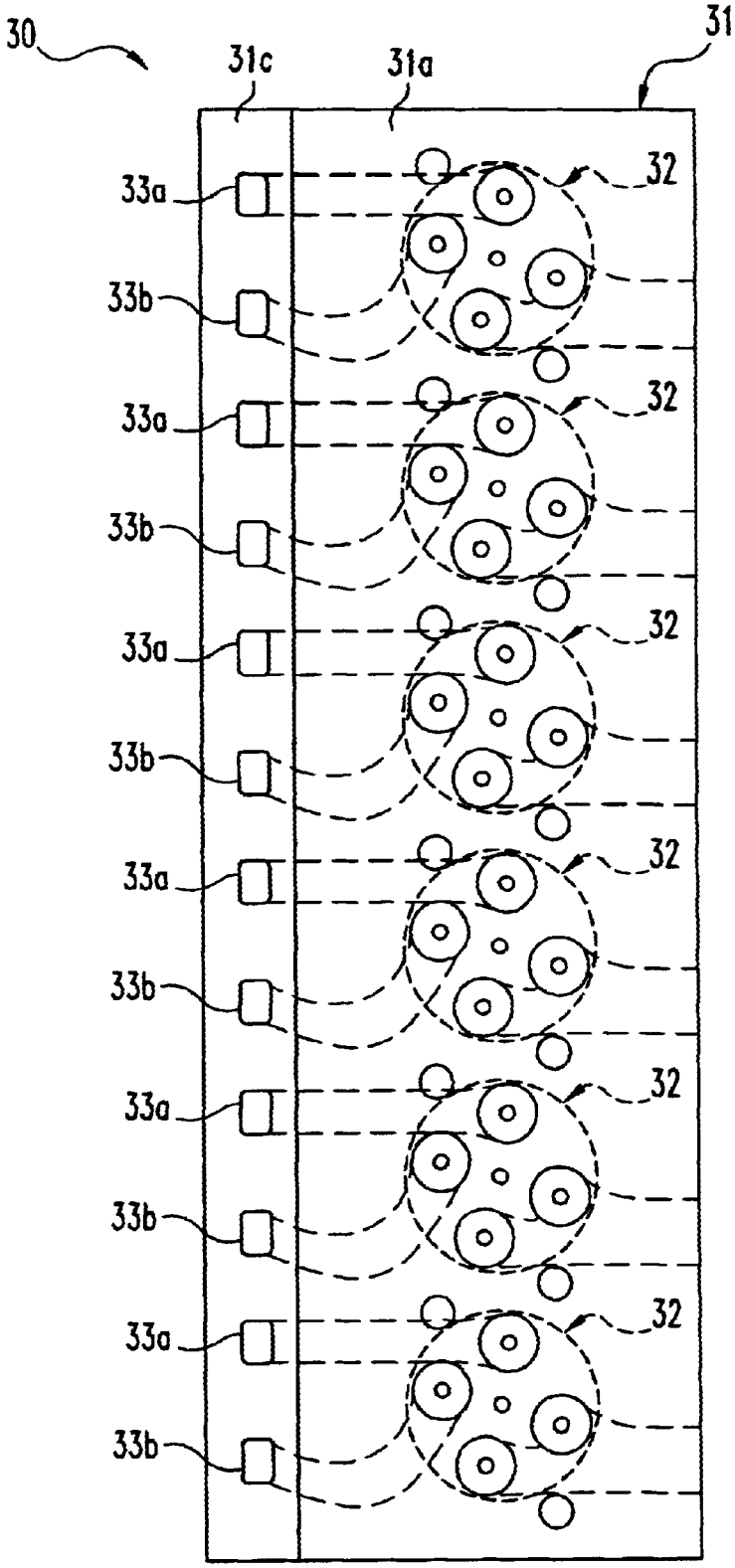
FIG. 2A is a diagrammatic top plan view of a second embodiment of a cylinder head in accordance with the present invention.
Figure 2C:
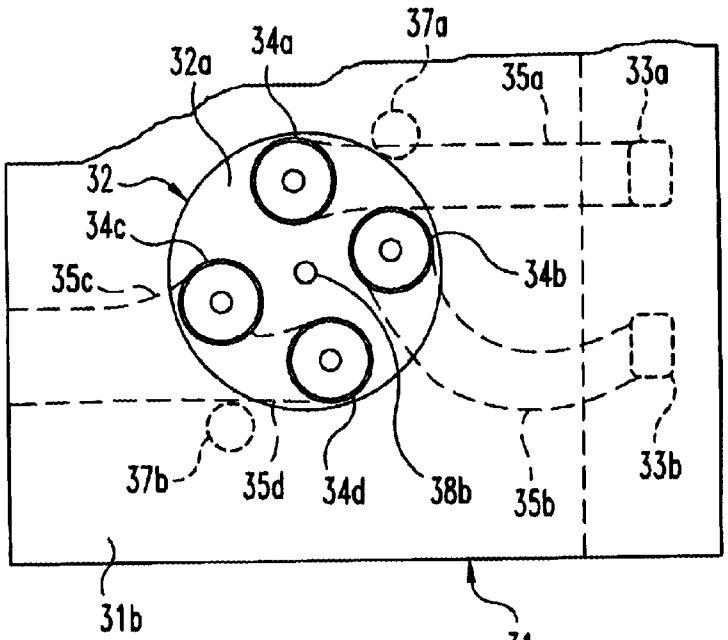
FIG. 2C is an enlarged, partial bottom plan view of the FIG. 2A cylinder head.
Figure 2B:
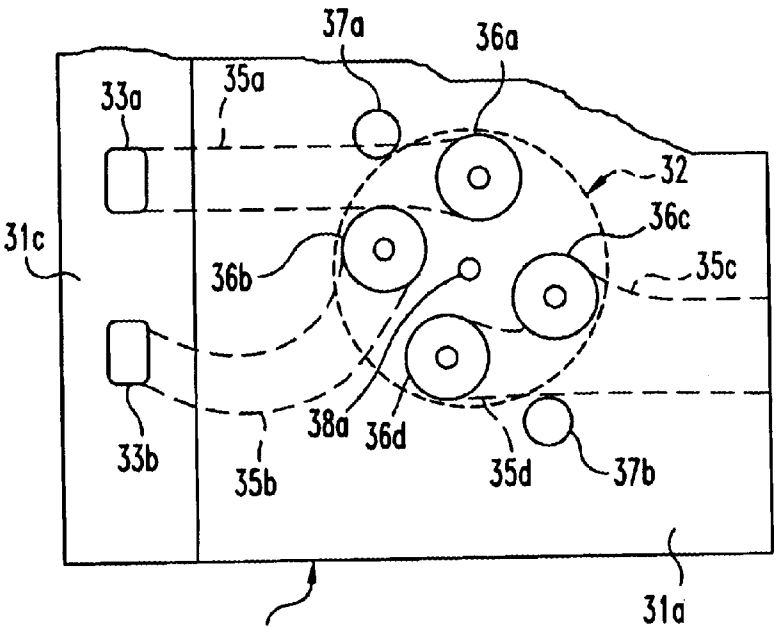
FIG. 2B is an enlarged, partial top plan view of the FIG. 2A cylinder head.

Referring to FIGS. 2A–2C, a second embodiment cylinder head 30 is shown. Cylinder head 30 includes a body 31, and one or more combustion chamber covers 32. Preferably, cylinder head 30 has six (6) combustion chamber covers 32 as shown. Combustion chamber covers 32 are recessed within and adjoined to a bottom surface 31*b* of body 31. Preferably, body 31 and combustion chamber covers 32 are fabricated as a unitary member. Combustion chamber covers 32 are positioned along bottom surface 31*b* whereby each combustion chamber cover 32 will be vertically aligned with a corresponding cylinder of an engine block when body 31 is adjoined to the engine block to thereby define combustion chambers between combustion chamber covers 32, the cylinders, and the pistons within the cylinders. Body 31 includes a pair of intake ports 33*a* and 33*b* for each combustion chamber cover 32. Intake ports 33*a* and 33*b* are disposed within a left side surface 31*c* of body 31. Left side surface 31*c* of body 31 is upwardly oriented to enhance fluid communication between intake ports 33*a* and 33*b* and an intake manifold (not shown) that is adjoined to body 31. Body 31 further includes an exhaust port (not shown) for each combustion chamber cover 32. The exhaust ports are disposed within a right side surface (not shown) of body 31.

With continued reference to FIGS. 2B and 2C, each combustion chamber cover 32 includes a pair of intake valve seats 34*a* and 34*b*, and a pair of exhaust valve seats 34*c* and 34*d*. The intake valve seats 34*a* and 34*b* and the exhaust valve seats 34*c* and 34*d* are recessed within a bottom surface 32*a* of each combustion chamber cover 32. Preferably, bottom surface 31*b* of body 31 and bottom surfaces 32*a* of combustion chamber covers 32 are planar and coplanar. For each combustion chamber cover 32, body 31 includes an intake fluid passage 35*a* extending from intake port 33*a* to intake valve seat 34*a* and an intake fluid passage 35*b* extending from intake port 33*b* to intake valve seat 34*b*. Alternatively, intake port 33*b* can be omitted from body 31 and intake fluid passages 35*a* and 35*b* can both extend from intake port 33*a* to intake valve seats 34*a* and 34*b*, respectively. Also for each combustion chamber cover 32, body 31 includes an exhaust fluid passage 35*c* extending from exhaust valve seat 34*c* to the corresponding exhaust port, and an exhaust fluid passage 35*d* extending from exhaust valve seat 34*d* to the corresponding exhaust port. Alternatively, for each combustion chamber cover 32, body 31 can further include a second exhaust port disposed within the right side surface of body 31 with exhaust fluid passages 35*d* extending from exhaust valve seats 34*d* to the second exhaust ports.

Preferably, intake fluid passages 35*a* and 35*b* have curvilinear configurations with two opposing arcs therein to facilitate a swirling of air introduced into a corresponding combustion chamber. The curvilinear configuration of intake fluid passage 35*b* is best illustrated in FIG. 14C. Referring to FIG. 14C, a forward arc segment 35*e* of intake fluid passage 35*b* diagonally extends from intake port 33*b* in a substantially downward direction and then bends toward a substantially horizontal direction. A rearward arc segment 35*f* of intake fluid passage 35*b* extends from forward arc segment 35*e* in a substantially horizontal direction and then bends in a substantially downward direction toward intake valve seat 34*b*. As a result, a substantial portion of any air flowing into intake port 33*b* through intake fluid passage 35*b* will circulate along a portion of an open intake valve 201*b* as the air enters into the corresponding combustion chamber. Consequently, the air swirls within the combustion chamber. To enhance the swirling of the air into the combustion chambers, intake valve seats 34*a* and 34*b* are positioned within combustion chamber covers 32 such that air entering the combustion chambers through intake valve seats 34*a* swirls in substantially the same direction as the air entering the combustion chambers through intake valve seats 34*b*.

Referring again to FIGS. 2B and 2C, for each combustion chamber cover 32, body 31 additionally includes a pair of intake bores 36*a* and 36*b* and a pair of exhaust bores 36*c* and 36*d* disposed therein. Each intake bore 36*a* extends from top surface 31*a* of body 31 to a corresponding intake fluid passage 35*a*. Each intake bore 36*b* extends from top surface 31*a* of body 31 to a corresponding intake fluid passage 35*b*. Each intake bore 36*c* extends from top surface 31*a* of body 31 to a corresponding exhaust fluid passage 35*c*. Each intake bore 36*d* extends from top surface 31*a* of body 31 to a corresponding exhaust fluid passage 35*d*. Body 31 also includes an intake lash adjuster seat 37*a*, and an exhaust lash adjuster seat 37*b* for each combustion chamber cover 32. Each intake lash adjuster seat 37*a* is disposed within top surface 31*a* of body 31 and is adjacent corresponding intake bores 36*a* and 36*b*. For each combustion chamber cover 32, intake bores 36*a* and 36*b* and intake lash adjuster seat 37*a* are positioned to support a mounting upon body 31 of an intake crosshead 90 of an intake valve assembly 200 as best illustrated in FIG. 14B. Each exhaust lash adjuster seat 37*b* is disposed within top surface 31*b* of body 31 and is adjacent corresponding exhaust bores 36*c* and 36*d*. For each combustion chamber cover 32, exhaust bores 36*c* and 36*d* and exhaust lash adjuster seat 37*b* are positioned to support a mounting upon body 31 of an exhaust crosshead 90 of an exhaust valve assembly 210 as best illustrated in FIG. 14B. Body 31 further includes a fuel injector bore 38*a* for each combustion chamber cover 32, and combustion chamber covers 32 include a fuel injector bore 38*b* that is vertically aligned with a corresponding fuel injector bore 38*a*.

Figure 3A:
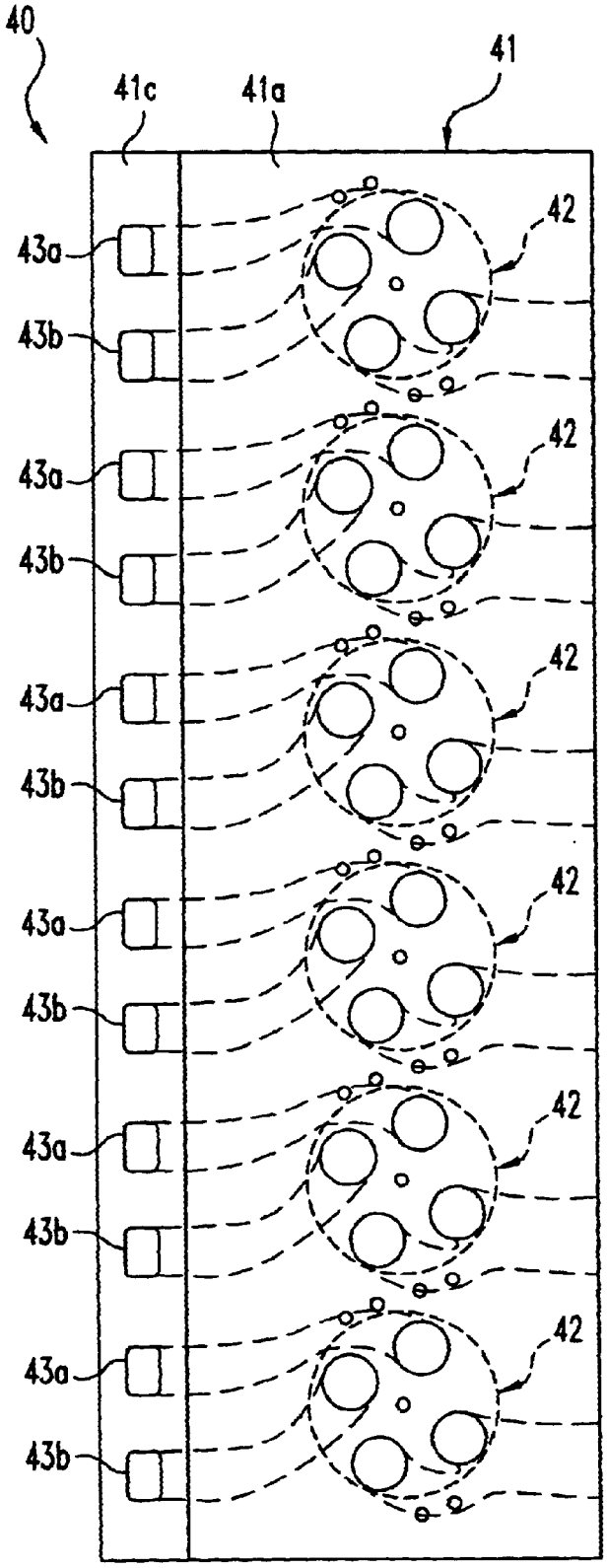
FIG. 3A is a diagrammatic top plan view of a third embodiment of a cylinder head in accordance with the present invention.
Figure 3C:
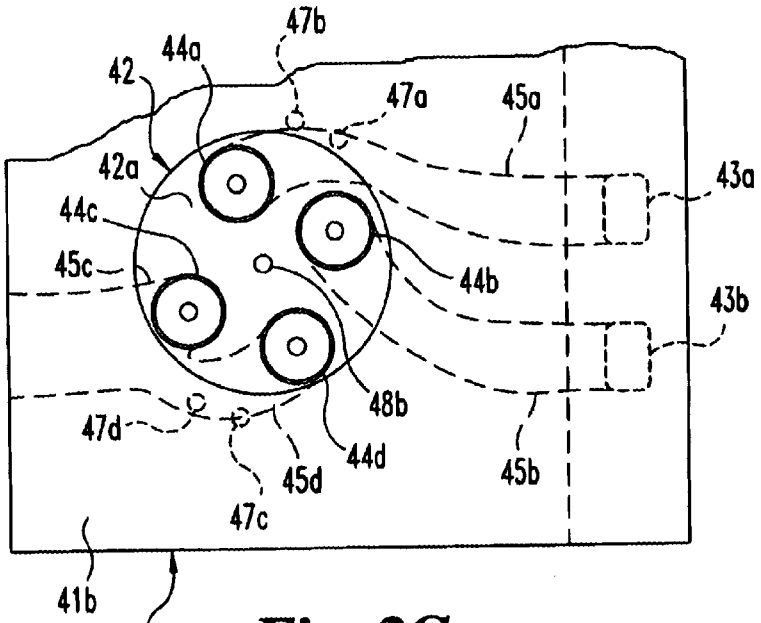
FIG. 3C is an enlarged, partial bottom plan view of the FIG. 3A cylinder head.
Figure 3B:
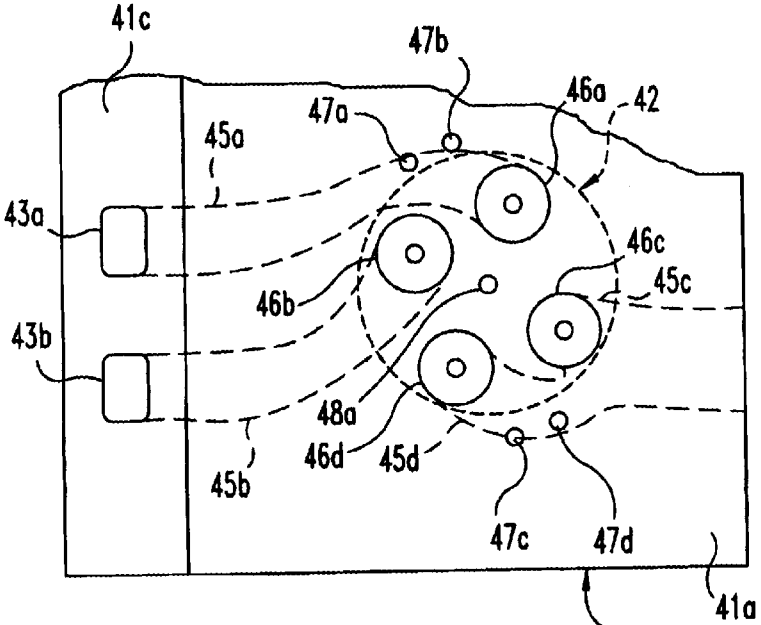
FIG. 3B is an enlarged, partial top plan view of the FIG. 3A cylinder head.

Referring to FIGS. 3A–3C, a third embodiment cylinder head 40 is shown. Cylinder head 40 includes a body 41, and one or more combustion chamber covers 42. Preferably, cylinder head 40 has six (6) combustion chamber covers 42 as shown. Combustion chamber covers 42 are recessed within and adjoined to a bottom surface 41*b* of body 41. Preferably, body 41 and combustion chamber covers 42 are fabricated as a unitary member. Combustion chamber covers 42 are positioned along bottom surface 41*b* whereby each combustion chamber cover 42 will be vertically aligned with a corresponding cylinder of an engine block when body 41 is adjoined to the engine block to thereby define combustion chambers between combustion chamber covers 42, the cylinders, and the pistons within the cylinders. Body 41 includes a pair of intake ports 43*a* and 43*b* for each combustion chamber cover 42. Intake ports 43*a* and 43*b* are disposed within a left side surface 41*c* of body 41. Left side surface 41*c* of body 41 is upwardly oriented to enhance fluid communication between intake ports 43*a* and 43*b* and an intake manifold (not shown) that is adjoined to body 41. Body 41 further includes an exhaust port (not shown) for each combustion chamber cover 42. The exhaust ports are disposed within a right side surface (not shown) of body 41.

With continued reference to FIGS. 3B and 3C, each combustion chamber cover 42 includes a pair of intake valve seats 44*a* and 44*b*, and a pair of exhaust valve seats 44*c* and 44*d*. The intake valve seats 44*a* and 44*b* and the exhaust valve seats 44*c* and 44*d* are recessed within a bottom surface 42*a* of each combustion chamber cover 42. Preferably, bottom surface 41*b* of body 41 and bottom surfaces 42*a* of combustion chamber covers 42 are planar and coplanar. For each combustion chamber cover 42, body 41 includes an intake fluid passage 45*a* extending from intake port 43*a* to intake valve seat 44*a* and an intake fluid passage 45*b* extending from intake port 43*b* to intake valve seat 44*b*. Alternatively, intake port 43*b* can be omitted from body 41 and intake fluid passages 45*a* and 45*b* can both extend from intake port 43*a* to intake valve seats 44*a* and 44*b*, respectively. Also for each combustion chamber cover 42, body 41 includes an exhaust fluid passage 45*c* extending from exhaust valve seat 44*c* to the corresponding exhaust port, and an exhaust fluid passage 45*d* extending from exhaust valve seat 44*d* to the corresponding exhaust port. Alternatively, for each combustion chamber cover 42, body 41 can further include a second exhaust port disposed within the right side surface of body 41 with exhaust fluid passages 45*d* extending from exhaust valve seats 44*d* to the second exhaust ports.

Preferably, intake fluid passages 45*a* and 45*b* have curvilinear configurations with two opposing arcs therein to facilitate a swirling of air introduced into a corresponding combustion chamber. The curvilinear configuration of intake fluid passage 45*b* is best illustrated in FIG. 15C. Referring to FIG. 15C, a forward arc segment 45*e* of intake fluid passage 45*b* diagonally extends from intake port 43*b* in a substantially downward direction and then bends toward a substantially horizontal direction. A rearward arc segment 45*f* of intake fluid passage 45*b* extends from forward arc segment 45*e* in a substantially horizontal direction and then bends in a substantially downward direction toward intake valve seat 44*b*. As a result, a substantial portion of any air flowing into intake port 43*b* through intake fluid passage 45*b* will circulate along a portion of an open intake valve 231*b* as the air enters into the corresponding combustion chamber. Consequently, the air swirls within the combustion chamber. To enhance the swirling of the air into the combustion chambers, intake valve seats 44*a* and 44*b* are positioned within combustion chamber covers 42 such that air entering the combustion chambers through intake valve seats 44*a* swirls in substantially the same direction as the air entering the combustion chambers through intake valve seats 44*b*.

Referring again to FIGS. 3B and 3C, for each combustion chamber cover 42, body 41 additionally includes a pair of intake bores 46*a* and 46*b* and a pair of exhaust bores 46*c* and 46*d* disposed therein. Each intake bore 46*a* extends from top surface 41*a* of body 41 to a corresponding intake fluid passage 45*a*. Each intake bore 46*b* extends from top surface 41*a* of body 41 to a corresponding intake fluid passage 45*b*. Each intake bore 46*c* extends from top surface 41*a* of body 41 to a corresponding exhaust fluid passage 45*c*. Each intake bore 46*d* extends from top surface 41*a* of body 41 to a corresponding exhaust fluid passage 45*d*. Body 41 also includes a pair of intake lash adjuster seats 47*a* and 47*b*, and a pair of exhaust lash adjuster seats 47*c* and 47*d* for each combustion chamber cover 42. Intake lash adjuster seats 47*a* and 47*b* are disposed within top surface 41*a* of body 41 and are adjacent corresponding intake bores 46*a* and 46*b*. For each combustion chamber cover 42, intake bores 46*a* and 46*b* and intake lash adjuster seats 47*a* and 47*b* are positioned to support a mounting upon body 41 of an intake crosshead 100 of an intake valve assembly 230 as best illustrated in FIG. 15B. Exhaust lash adjuster seats 47*c* and 47*d* are disposed within top surface 41*b* of body 41 and are adjacent corresponding exhaust bores 46*c* and 46*d*. For each combustion chamber cover 42, exhaust bores 46*c* and 46*d* and exhaust lash adjuster seats 47*c* and 47*d* are positioned to support a mounting upon body 41 of an exhaust crosshead 100 of an exhaust valve assembly 240 as best illustrated in FIG. 15B. Body 41 further includes a fuel injector bore 48*a* for each combustion chamber cover 42, and combustion chamber covers 42 include a fuel injector bore 48*b* that is vertically aligned with a corresponding fuel injector bore 48*a*.

Figure 4A:
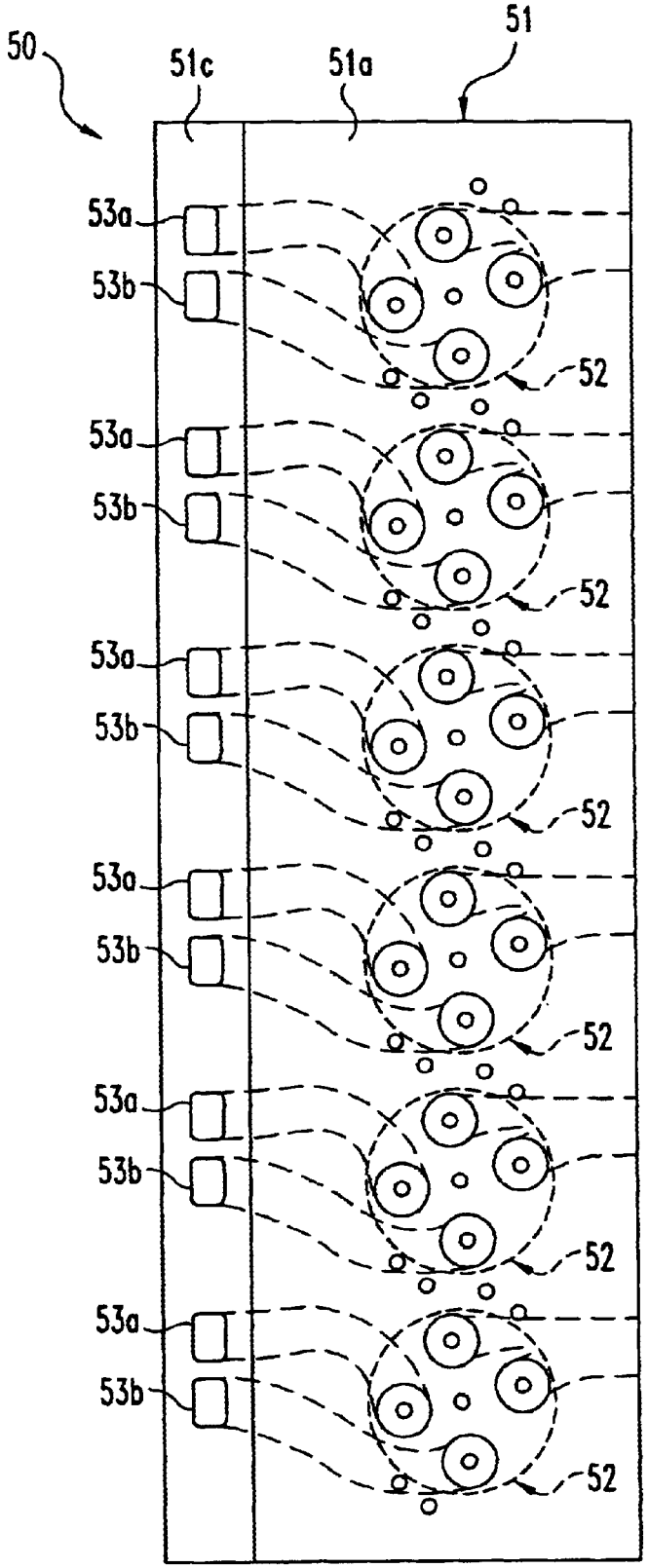
FIG. 4A is a diagrammatic top plan view of a fourth embodiment of a cylinder head in accordance with the present invention.
Figure 4C:
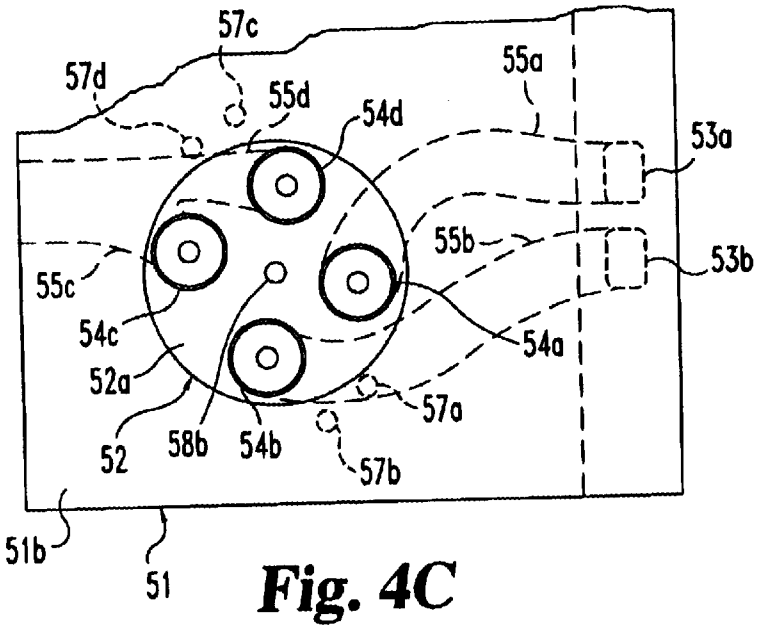
FIG. 4C is an enlarged, partial bottom plan view of the FIG. 4A cylinder head.
Figure 4B:
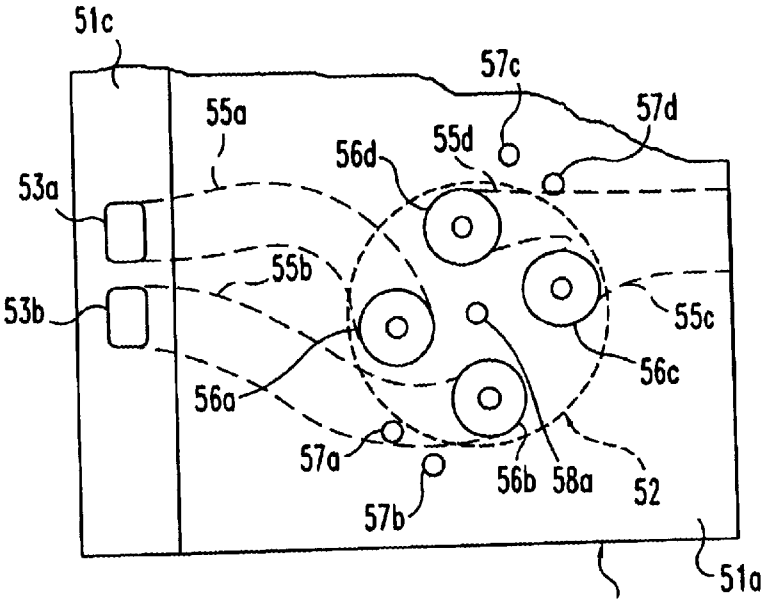
FIG. 4B is an enlarged, partial top plan view of the FIG. 4A cylinder head.

Referring to FIGS. 4A–4C, a fourth embodiment cylinder head 50 is shown. Cylinder head 50 includes a body 51, and one or more combustion chamber covers 52. Preferably, cylinder head 50 has six (6) combustion chamber covers 52 as shown. Combustion chamber covers 52 are recessed within and adjoined to a bottom surface 51*b* of body 51. Preferably, body 51 and combustion chamber covers 52 are fabricated as a unitary member. Combustion chamber covers 52 are positioned along bottom surface 51*b* whereby each combustion chamber cover 52 will be vertically aligned with a corresponding cylinder of an engine block when body 51 is adjoined to the engine block to thereby define combustion chambers between combustion chamber covers 52, the cylinders, and the pistons within the cylinders. Body 51 includes a pair of intake ports 53*a* and 53*b* for each combustion chamber cover 52. Intake ports 53*a* and 53*b* are disposed within a left side surface 51*c* of body 51. Left side surface 51*c* of body 51 is upwardly oriented to enhance fluid communication between intake ports 53*a* and 53*b* and an intake manifold (not shown) that is adjoined to body 51. Body 51 further includes an exhaust port (not shown) for each combustion chamber cover 52. The exhaust ports are disposed within a right side surface (not shown) of body 51.

With continued reference to FIGS. 4B and 4C, each combustion chamber cover 52 includes a pair of intake valve seats 54*a* and 54*b*, and a pair of exhaust valve seats 54*c* and 54*d*. The intake valve seats 54*a* and 54*b* and the exhaust valve seats 54*c* and 54*d* are recessed within a bottom surface 52*a* of each combustion chamber cover 52. Preferably, bottom surface 51*b* of body 51 and bottom surfaces 52*a* of combustion chamber covers 52 are planar and coplanar. For each combustion chamber cover 52, body 51 includes an intake fluid passage 55*a* extending from intake port 53*a* to intake valve seat 54*a* and an intake fluid passage 55*b* extending from intake port 53*b* to intake valve seat 54*b*. Alternatively, intake port 53*b* can be omitted from body 51 and intake fluid passages 55*a* and 55*b* can both extend from intake port 53*a* to intake valve seats 54*a* and 54*b*, respectively. Also for each combustion chamber cover 52, body 51 includes an exhaust fluid passage 55*c* extending from exhaust valve seat 54*c* to the corresponding exhaust port, and an exhaust fluid passage 55*d* extending from exhaust valve seat 54*d* to the corresponding exhaust port. Alternatively, for each combustion chamber cover 52, body 51 can further include a second exhaust port disposed within the right side surface of body 51 with exhaust fluid passages 55*d* extending from exhaust valve seats 54*d* to the second exhaust ports.

Preferably, intake fluid passages 55*a* and 55*b* have curvilinear configurations with two opposing arcs therein to facilitate a swirling of air introduced into a corresponding combustion chamber. The curvilinear configuration of intake fluid passage 55*a* is best illustrated in FIG. 16C. Referring to FIG. 16C, a forward arc segment 55*e* of intake fluid passage 55*a* diagonally extends from intake port 53*a* in a substantially downward direction and then bends toward a substantially horizontal direction. A rearward arc segment 55*f* of intake fluid passage 55*a* extends from forward arc segment 55*e* in a substantially horizontal direction and then bends in a substantially downward direction toward intake valve seat 54*a*. As a result, a substantial portion of any air flowing into intake port 53*a* through intake fluid passage 55*a* will circulate along a portion of an open intake valve 261*a* as the air enters into the corresponding combustion chamber. Consequently, the air swirls within the combustion chamber. To enhance the swirling of the air into the combustion chambers, intake valve seats 54*a* and 54*b* are positioned within combustion chamber covers 52 such that air entering the combustion chambers through intake valve seats 54*a* swirls in substantially the same direction as the air entering the combustion chambers through intake valve seats 54*b*.

Referring again to FIGS. 4B and 4C, for each combustion chamber cover 52, body 51 additionally includes a pair of intake bores 56*a* and 56*b* and a pair of exhaust bores 56*c* and 56*d* disposed therein. Each intake bore 56*a* extends from top surface 51*a* of body 51 to a corresponding intake fluid passage 55*a*. Each intake bore 56*b* extends from top surface 51*a* of body 51 of to a corresponding intake fluid passage 55*b*. Each intake bore 56*c* extends from top surface 51*a* of body 51 to a corresponding exhaust fluid passage 55*c*. Each intake bore 56*d* extends from top surface 51*a* of body 51 to a corresponding exhaust fluid passage 55*d*. Body 51 also includes a pair of intake lash adjuster seats 57*a* and 57*b*, and a pair of exhaust lash adjuster seats 57*c* and 57*d* for each combustion chamber cover 52. Intake lash adjuster seats 57*a* and 57*b* are disposed within top surface 51*a* of body 51 and are adjacent corresponding intake bores 56*a* and 56*b*. For each combustion chamber cover 52, intake bores 56*a* and 56*b* and intake lash adjuster seats 57*a* and 57*b* are positioned to support a mounting upon body 51 of an intake crosshead 110 of an intake valve assembly 260 as best illustrated in FIG. 16B. Exhaust lash adjuster seats 57*c* and 57*d* are disposed within top surface 51*a* of body 51 and are adjacent corresponding exhaust bores 56*c* and 56*d*. For each combustion chamber cover 52, exhaust bores 56*c* and 56*d* and exhaust lash adjuster seats 57*c* and 57*d* are positioned to support a mounting upon body 51 of an exhaust crosshead 110 of an exhaust valve assembly 270 as best illustrated in FIG. 16B. Body 51 further includes a fuel injector bore 58*a* for each combustion chamber cover 52, and combustion chamber covers 52 include a fuel injector bore 58*b* that is vertically aligned with a corresponding fuel injector bore 58*a*.

Figure 5A:
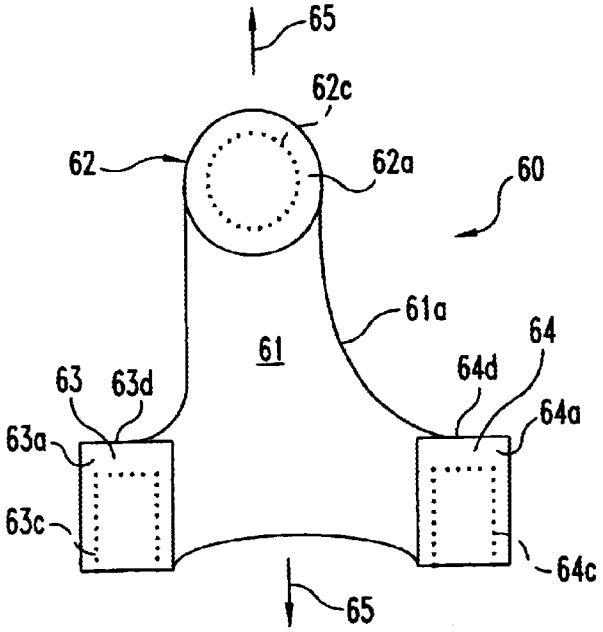
FIG. 5A is a top plan view of a first embodiment of a crosshead in accordance with the present invention.
Figure 5C:
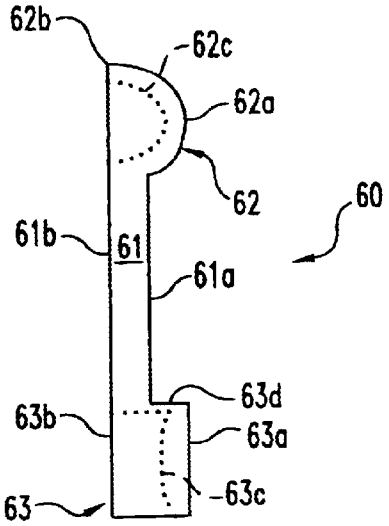
FIG. 5C is a left side elevational view of the FIG. 5A crosshead.
Figure 5B:
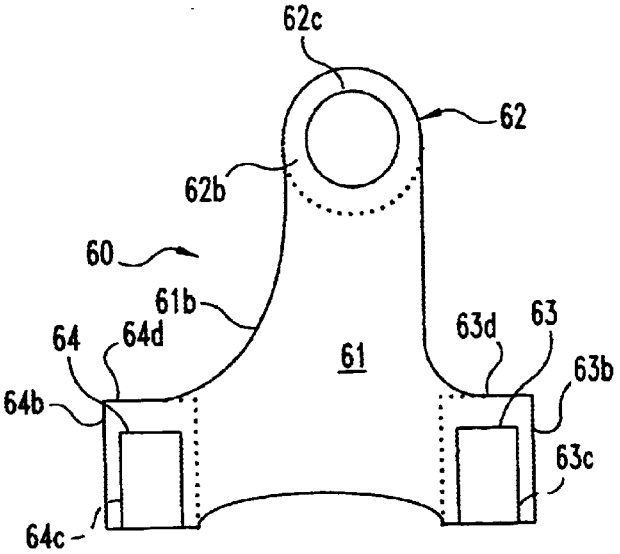
FIG. 5B is a bottom plan view of the FIG. 5A crosshead.
Figure 5D:
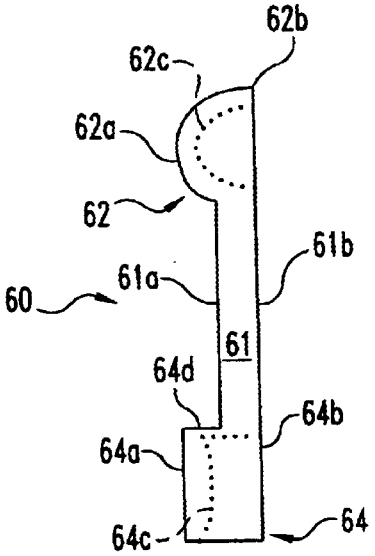
FIG. 5D is a right side elevational view of the FIG. 5A crosshead.

Referring to FIGS. 5A–5D, a first embodiment crosshead 60 is shown. Crosshead 60 comprises a body 61, a head 62 adjoined to body 61, an arm 63 adjoined to body 61, and an arm 64 adjoined to body 61. Preferably, body 61, head 62, arm 63, and arm 64 are fabricated as an unitary member. A generally hemispherical surface 62*a* of head 62 extends from a planar surface 61*a* of body 61. A planar surface 62*b* of head 62 extends from and is coplanar with a planar surface 61*b* of body 61. Head 62 has a generally hemispherical indentation 62*c* disposed within surface 62*b*. A planar surface 63*a* of arm 63 is separated from surface 61*a* by a sidewall 63*d*. A planar surface 63*b* of arm 63 extends from and is coplanar with surface 61*b*. Arm 63 includes a convex slot 63*c* disposed within surface 63*b*. A planar surface 64*a* of arm 64 is separated from surface 61*a* by sidewall 64*d*. A planar surface 64*b* of arm 64 extends from and is coplanar with surface 61*b*. Arm 64 includes a convex slot 64*c* disposed within surface 64*b*. Surfaces 61*a*, 61*b*, 62*b*, 63*a*, 63*b*, 64*a*, and 64*b* are substantially parallel. Crosshead 60 is designed to be mounted upon cylinder head 20 (FIGS. 1A through 1C) and the like. Thus, as shown in FIG. 5A, a left side portion and a right side portion of body 61 are asymmetrically configured and dimensioned relative to a longitudinal axis 65 centered between arms 63 and 64.

Figure 6A:
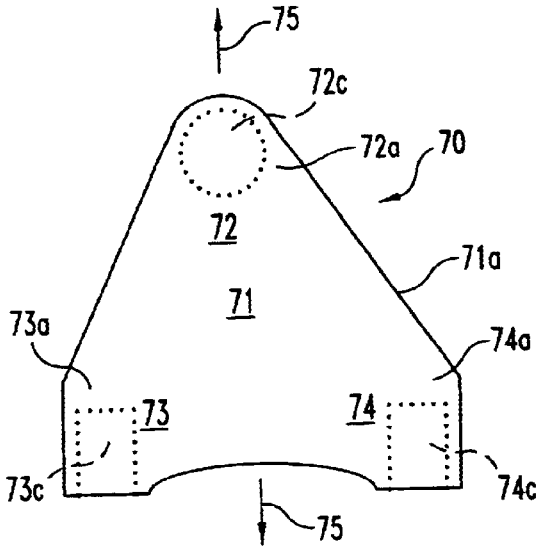
FIG. 6A is a top plan view of a second embodiment of a crosshead in accordance with the present invention.
Figure 6C:
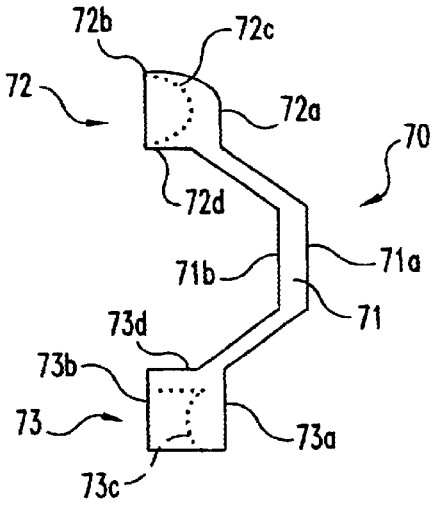
FIG. 6C is a left side elevational view of the FIG. 6A crosshead.
Figure 6B:
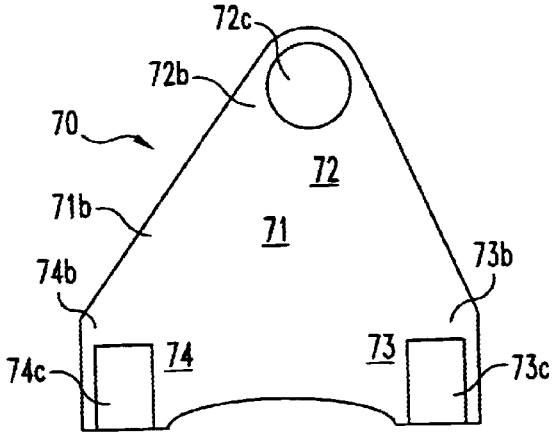
FIG. 6B is a bottom plan view of the FIG. 6A crosshead.
Figure 6D:
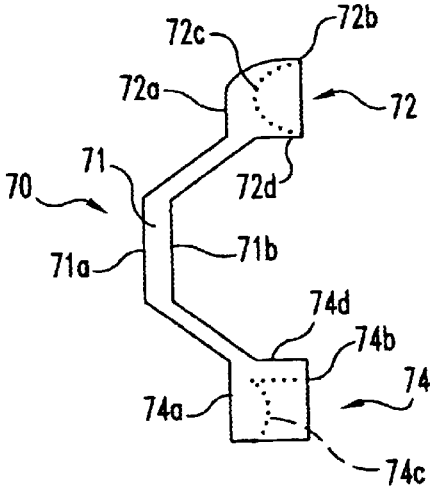
FIG. 6D is a right side elevational view of the FIG. 6A crosshead.

Referring to FIGS. 6A–6D, a second embodiment crosshead 70 is shown. Crosshead 70 comprises a body 71, a head 72 adjoined to body 71, an arm 73 adjoined to body 71, and an arm 74 adjoined to body 71. Preferably, body 71, head 72, arm 73, and arm 74 are fabricated as a unitary member. A planar and curved surface 72*a* of head 72 extends from surface 71*a* of body 71. A planar surface 72*b* of head 72 is separated from surface 71*b* of body 71 by a side wall 72*d*. Head 72 has a generally hemispherical indentation 72*c* disposed within surface 72*b*. A planar surface 73*a* of arm 73 extends from surface 71*a*. A planar surface 73*b* of arm 73 is separated from surface 71*b* by a side wall 73*d*. Arm 73 includes a convex slot 73*c* disposed within surface 73*b*. A planar surface 74*a* of arm 74 extends from surface 71*a*. A planar surface 74*b* of arm 74 is separated from surface 71*b* by a side wall 74*d*. Arm 74 includes a convex slot 74*c* disposed within surface 74*b*. Surfaces 71*a*, 71*b*, 72*a*, 72*b*, 73*a*, 73*b*, 74*a*, and 74*b* are substantially parallel. Surfaces 72*b*, 73*b*, and 74*b* are substantially coplanar. Crosshead 70 is designed to be mounted upon cylinder head 20 (FIGS. 1A through 1C) and the like. Thus, as shown in FIG. 6A, a left side portion and a right side portion of body 71 are asymmetrically configured and dimensioned relative to a longitudinal axis 75 centered between arms 73 and 74.

Figure 7A:
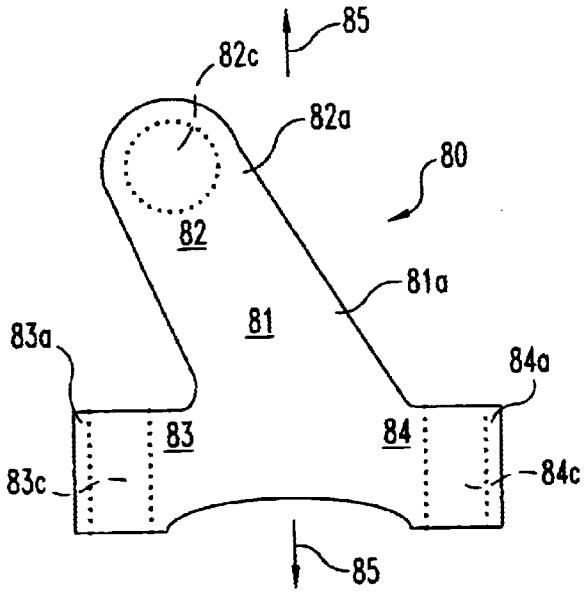
FIG. 7A is a top plan view of a third embodiment of a crosshead in accordance with the present invention.
Figure 7C:
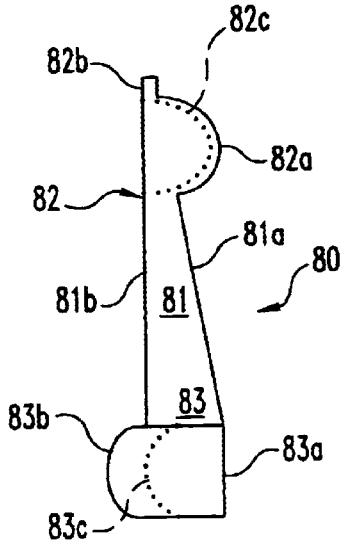
FIG. 7C is a left side elevational view of the FIG. 7A crosshead.
Figure 7B:
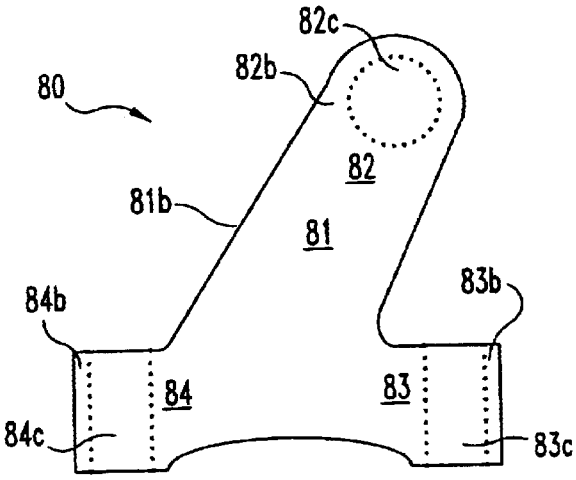
FIG. 7B is a bottom plan view of the FIG. 7A crosshead.
Figure 7D:
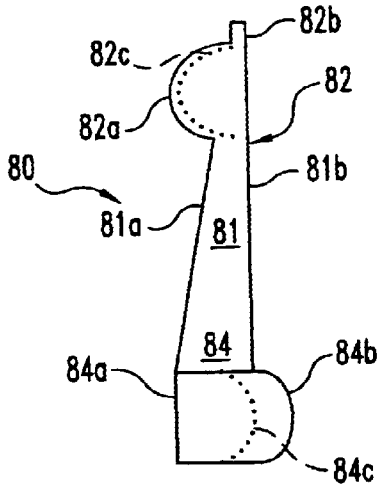
FIG. 7D is a right side elevational view of the FIG. 7A crosshead.

Referring to FIGS. 7A–7D, a third embodiment crosshead 80 is shown. Crosshead 80 comprises a body 81, a head 82 adjoined to body 81, an arm 83 adjoined to body 81, and an arm 84 adjoined to body 81. Preferably, body 81, head 82, arm 83, and arm 84 are fabricated as a unitary member. A generally hemispherical surface 82*a* of head 82 extends from a planar surface 81*a* of body 81. A planar surface 82*b* of head 82 extends from a planar surface 81*b* of body 81. Head 82 has a generally hemispherical indentation 82*c* disposed within surface 82*b*. A planar surface 83*a* of arm 83 angularly extends from surface 81*a*. A generally convex surface 83*b* of arm 83 extends from surface 81*b*. Arm 83 includes a generally convex slot 83*c* disposed within surface 83*b*. A planar surface 84*a* of arm 84 angularly extends from surface 81*a*. Surface 81*a* is inclined from surface 82*a* to surfaces 83*a* and 84*a*. A generally convex surface 84*b* of arm 84 extends from surface 81*b*. Arm 84 includes a generally convex slot 84*c* disposed within surface 84*b*. Crosshead 80 is designed to be mounted upon cylinder head 20 (FIGS. 1A through 1C) and the like. Thus, as shown in FIG. 7A, a left side portion and a right side portion of body 81 are asymmetrically configured and dimensioned relative to a longitudinal axis 85 centered between arms 83 and 84.

Figure 8A:
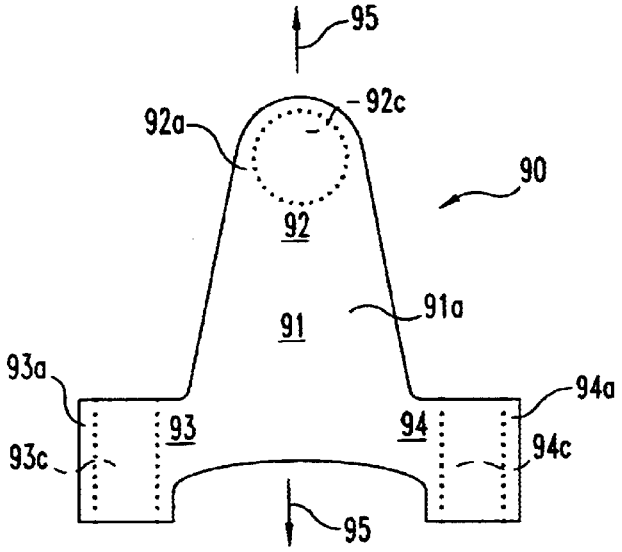
FIG. 8A is a top plan view of a fourth embodiment of a crosshead in accordance with the present invention.
Figure 8C:
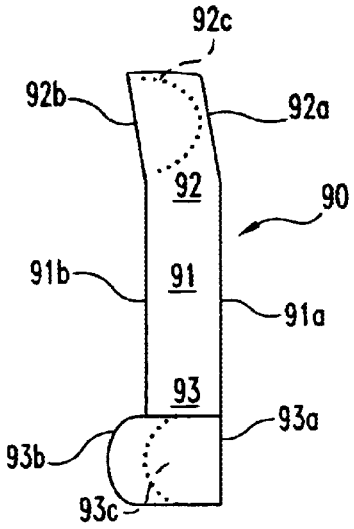
FIG. 8C is a left side elevational view of the FIG. 8A crosshead.
Figure 8B:
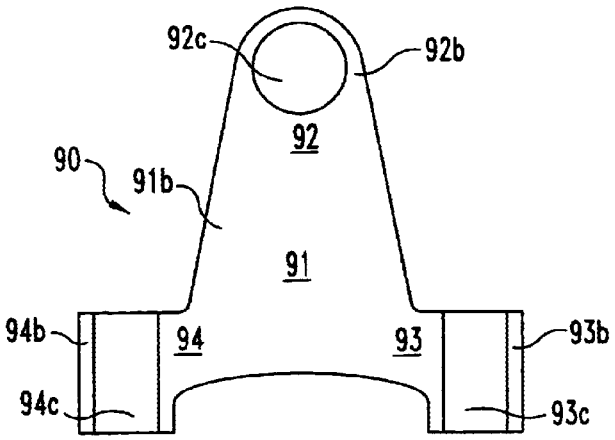
FIG. 8B is a bottom plan view of the FIG. 8A crosshead.
Figure 8D:
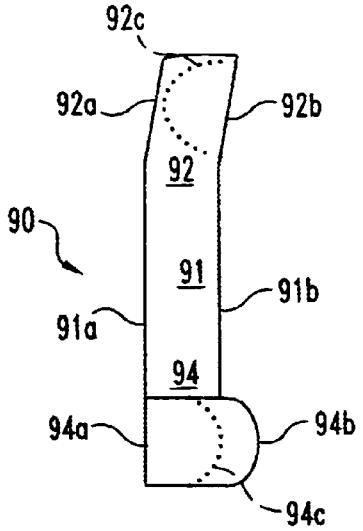
FIG. 8D is a right side elevational view of the FIG. 8A crosshead.

Referring to FIGS. 8A–8D, a fourth embodiment crosshead 90 is shown. Crosshead 90 comprises a body 91, a head 92 adjoined to body 91, an arm 93 adjoined to body 91, and an arm 94 adjoined to body 91. Preferably, body 91, head 92, arm 93, and arm 94 are fabricated as a unitary member. A planar surface 92*a* of head 92 downwardly extends from a planar surface 91*a* of body 91. A planar surface 92*b* of head 92 downwardly extends from a planar surface 91*b* of body 91. Head 92 has a generally hemispherical indentation 92*c* disposed within planar surface 92*b*. A planar surface 93*a* of arm 93 extends from surface 91*a* of body 91. A generally convex surface 93*b* of arm 93 extends from surface 91*b*. Arm 93 includes a generally convex slot 93*c* disposed within surface 93*b*. A planar surface 94*a* of arm 94 extends from surface 91*a* of body 91. A generally convex surface 94*b* of arm 94 extends from surface 91*b* of body 91. Arm 94 includes a generally convex slot 94*c* disposed within surface 94*b*. Surfaces 91*a*, 91*b*, 93*a*, and 94*a* are substantially parallel. Surfaces 91*a*, 93*a*, and 94*a* are substantially coplanar. Crosshead 90 is designed to be mounted upon cylinder head 30 (FIGS. 2A through 2C) and the like. Thus, as shown in FIG. 8A, a left side portion and a right side portion of body 91 are symmetrically configured and dimensioned relative to a longitudinal axis 95 centered between arms 93 and 94.

Figure 9A:
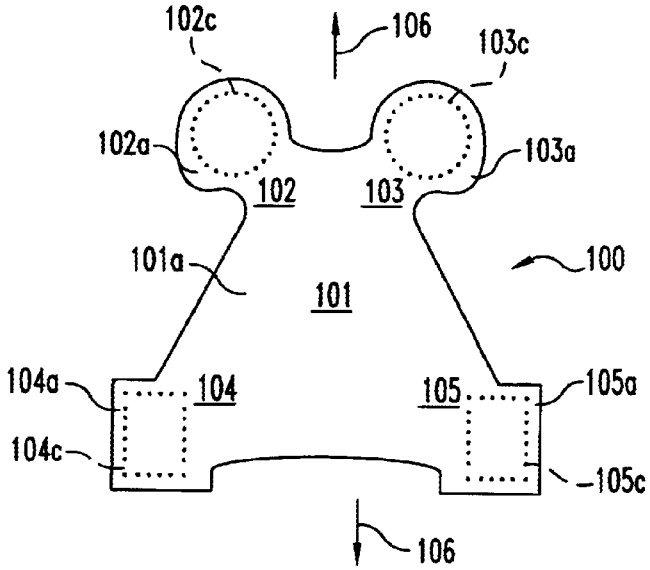
FIG. 9A is a top plan view of a fifth embodiment of a crosshead in accordance with the present invention.
Figure 9C:
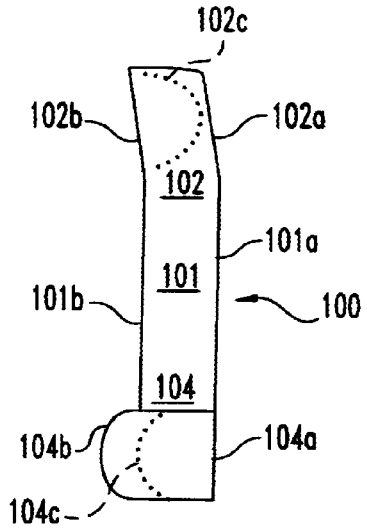
FIG. 9C is a left side elevational view of the FIG. 9A crosshead.
Figure 9B:
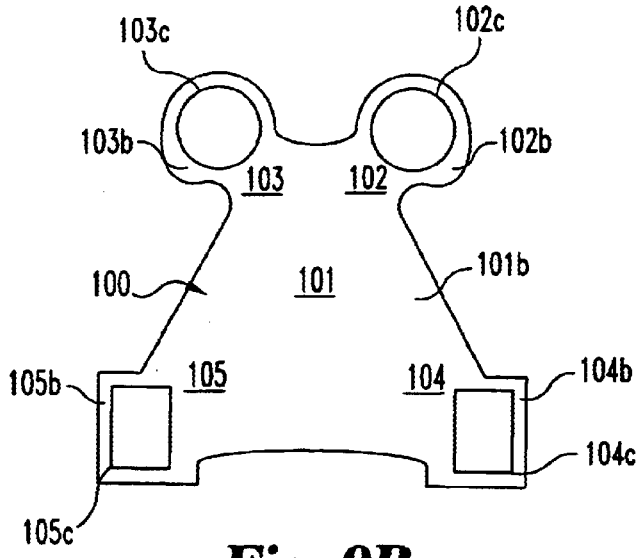
FIG. 9B is a bottom plan view of the FIG. 9A crosshead.
Figure 9D:
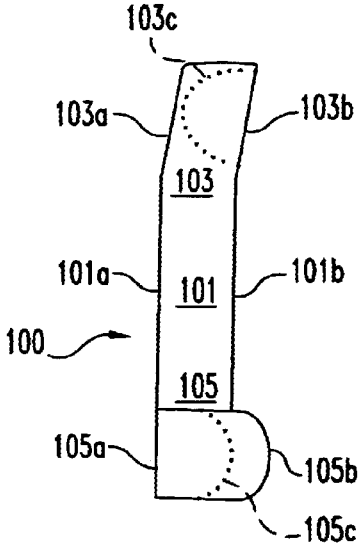
FIG. 9D is a right side elevational view of the FIG. 9A crosshead.

Referring to FIGS. 9A–9D, a fifth embodiment crosshead 100 is shown. Crosshead 100 comprises a body 101, a head 102 adjoined to body 101, a head 103 adjoined to body 101, an arm 104 adjoined to body 101, and an arm 105 adjoined body 101. Preferably, body 101, head 102, head 103, arm 104, and arm 105 are fabricated as an unitary member. A planar surface 102*a* of head 102 downwardly extends from a planar surface 101*a* of body 101. A planar surface 102*b* of head 102 downwardly extends from a planar surface 101*b* of body 101. Head 102 has a generally hemispherical indentation 102*c* disposed within surface 102*b*. A planar surface 103*a* of head 103 downwardly extends from planar surface 101*a* of body 101. A planar surface 103*b* of head 103 downwardly extends from planar surface 101*b* of body 101. Head 103 has a generally hemispherical indentation 103*c* disposed within surface 103*b*. A planar surface 104*a* of arm 104 extends from surface 101*a* of body 101. A generally convex surface 104*b* of arm 104 extends from surface 101*b* of body 101. Arm 104 includes a generally convex slot 104*c* disposed within surface 104*b*. A planar surface 105*a* of arm 105 extends from surface 101*a* of body 101. A generally convex surface 105*b* of arm 105 extends from surface 101*b* of body 101. Arm 105 includes a generally convex slot 105*c* disposed within surface 105*b*. Surfaces 101*a*, 101*b*, 104*a*, and 105*a* are substantially parallel. Surfaces 101*a*, 104*a*, and 105*a* are substantially coplanar. Crosshead 100 is designed to be mounted upon cylinder head 40 (FIGS. 3A through 3C) and the like. Thus, as shown in FIG. 9A, a left side portion and a right side portion of body 101 are symmetrically configured and dimensioned relative to a longitudinal axis 106 centered between arms 103 and 104.

Figure 10A:
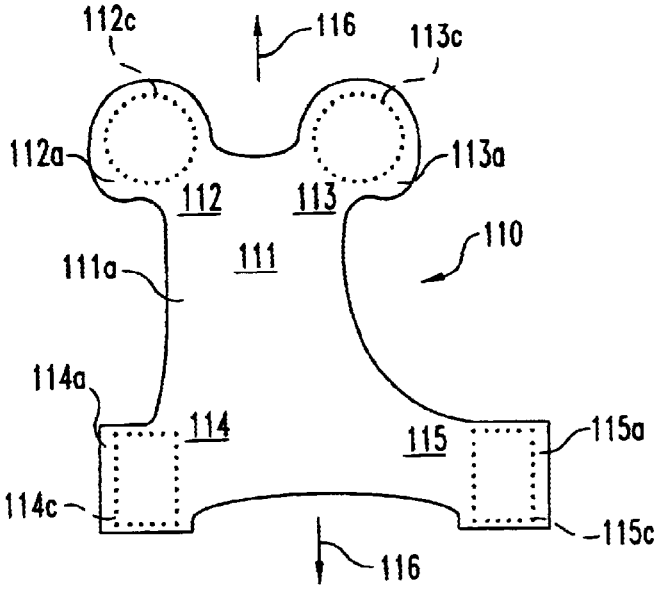
FIG. 10A is a top plan view of a sixth embodiment of a crosshead in accordance with the present invention.
Figure 10C:
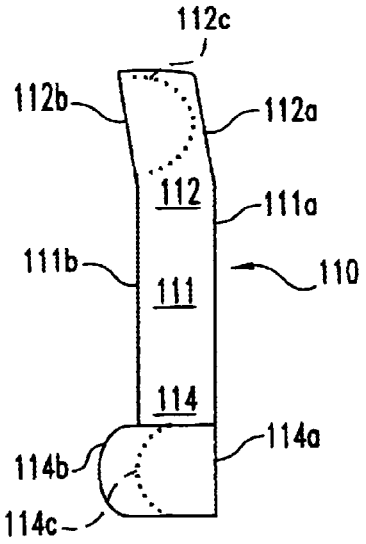
FIG. 10C is a left side elevational view of the FIG. 10A crosshead.
Figure 10B:
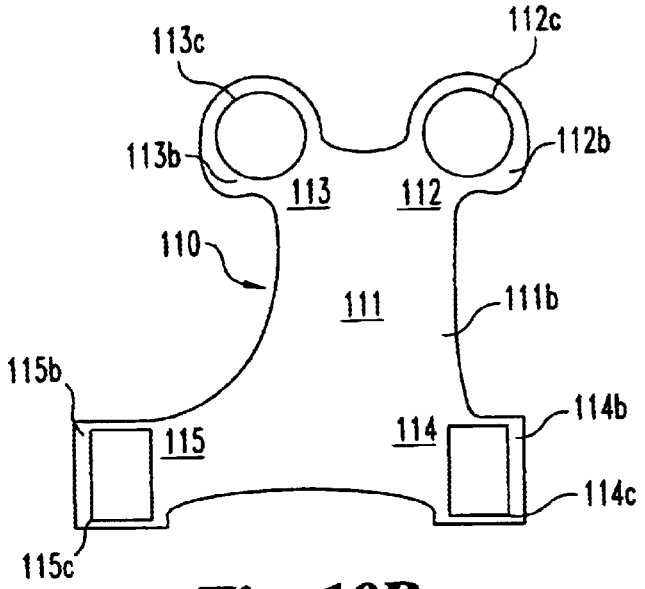
FIG. 10B is a bottom plan view of the FIG. 10A crosshead.
Figure 10D:
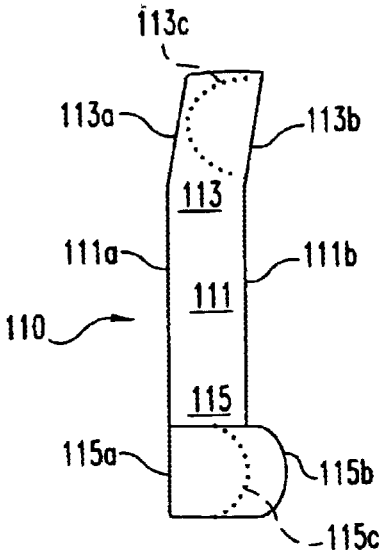
FIG. 10D is a right side elevational view of the FIG. 10A crosshead.

Referring to FIGS. 10A–10D, a sixth embodiment crosshead 110 is shown. Crosshead 110 comprises a body 111, a head 112 adjoined to body 111, a head 113 adjoined to body 111, an arm 114 adjoined to body 111, and an arm 115 adjoined to body 111. Preferably, body 111, head 112, head 113, arm 114, and arm 115 are fabricated as an unitary member. A planar surface 112*a* of head 112 downwardly extends from a planar surface 111*a* of body 111. A planar surface 112*b* of head 112 downwardly extends from a planar surface 111*b* of body 111. Head 112 has a generally hemispherical indentation 112*c* disposed within surface 112*b*. A planar surface 113*a* of head 113 downwardly extends from a planar surface 111*a* of body 111. A planar surface 113*b* of head 113 downwardly extends from a planar surface 111*b* of body 111. Head 113 has a generally hemispherical indentation 113*c* disposed within surface 113*b*. A planar surface 114*a* of arm 114 extends from surface 111*a* of body 111. A generally convex surface 114*b* of arm 114 extends from surface 111*b* of body 111. Arm 114 includes a generally convex slot 114*c* disposed within surface 114*b*. A planar surface 115*a* of arm 115 extends from surface 111*a* of body 111. A generally convex surface 115*b* of arm 115 extends from surface 111*b* of body 111. Arm 115 includes a generally convex slot 115*c* disposed within surface 115*b*. Surfaces 111*a*, 111*b*, 114*a*, and 115*a* are substantially parallel. Surfaces 111*a*, 114*a*, and 115*a* are substantially coplanar. Crosshead 110 is designed to be mounted upon cylinder head 50 (FIGS. 4A through 4C) and the like. Thus, as shown in FIG. 10A, a left side portion and a right side portion of body 111 are asymmetrically configured and dimensioned relative to a longitudinal axis 116 centered between arms 113 and 114.

Figure 11B:
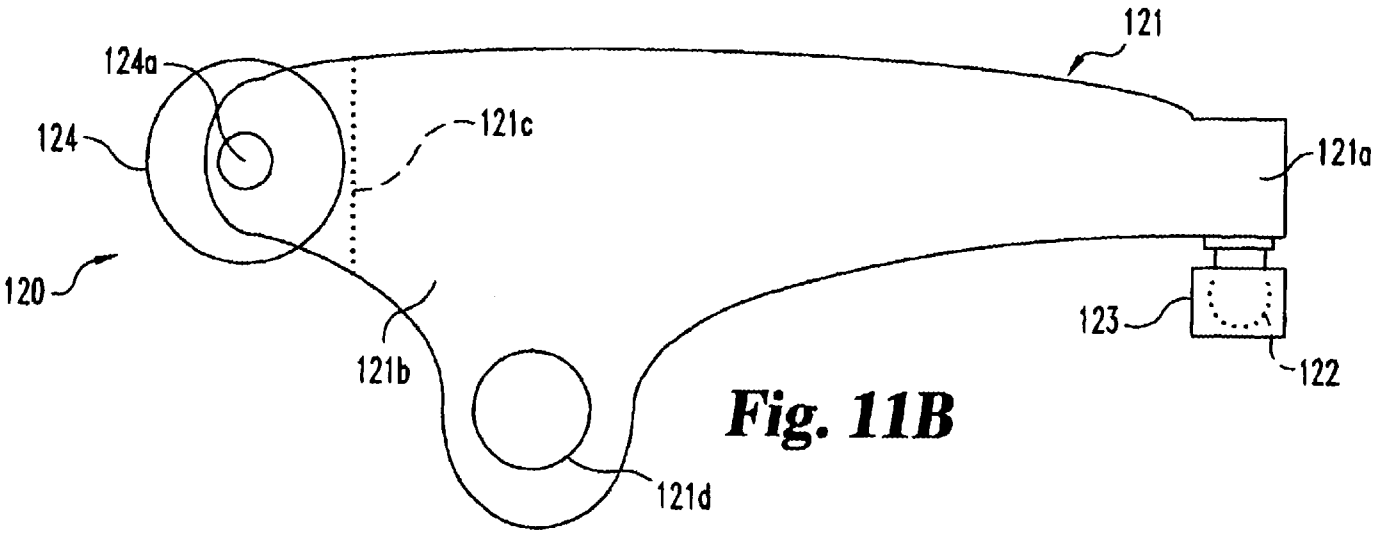
FIG. 11B is a right side elevational view of the FIG. 11A rocker arm.
Figure 11A:
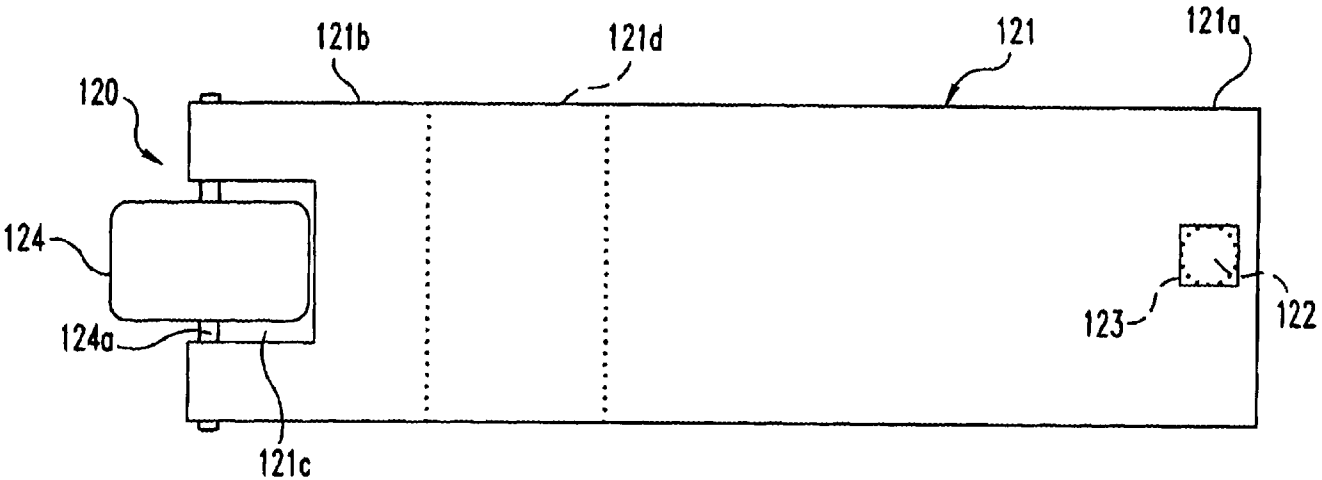
FIG. 11A is a top plan view of a first embodiment of a rocker arm in accordance with the present invention.

Referring to FIGS. 11A and 11B, a first embodiment rocker arm 120 is shown. Rocker arm 120 comprises a body 121, an elephant foot 122, a casing 123, and a wheel 124. Elephant foot 122 is adjoined to (preferably affixed to) a bottom surface of a distal end 121*a* of body 121. Casing 123 is movably adjoined to (preferably movably engaged with) elephant foot 122. Casing 123 can be positioned in various angular orientations relative to elephant foot 122. Wheel 124 is inserted within a slot 121*c* disposed in an upper portion of a proximal end 121*b* of body 121, and is rotatably adjoined with (preferably detachably coupled to) end 121*b* by a pin 124*a*. A generally cylindrical aperture 121*d* extends through a lower portion of proximal end 121*b* of body 121. Aperture 121*d* is spaced from slot 121*c*.

Figure 12B:
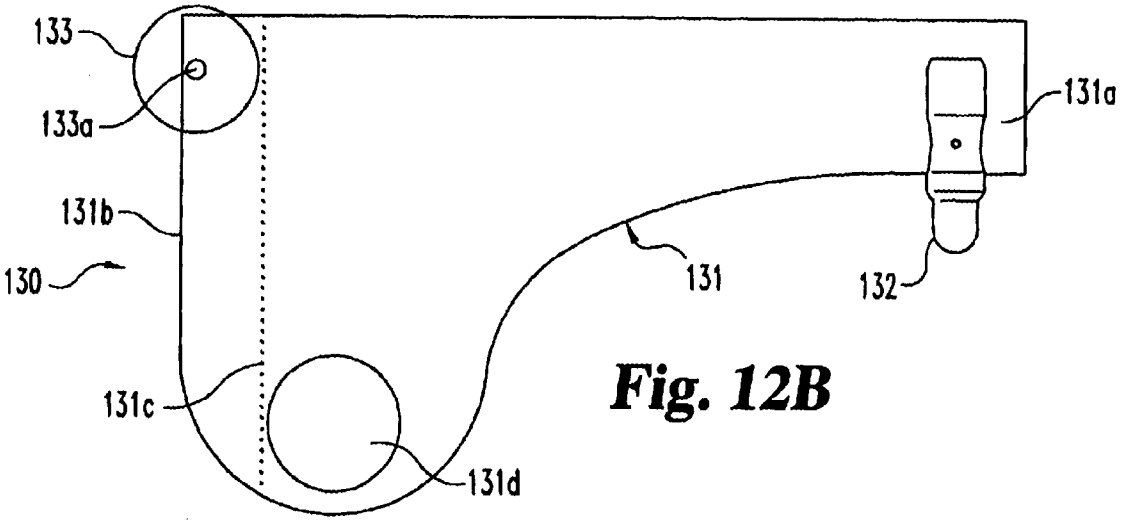
FIG. 12B is a right side elevational view of the FIG. 12A rocker arm.
Figure 12A:
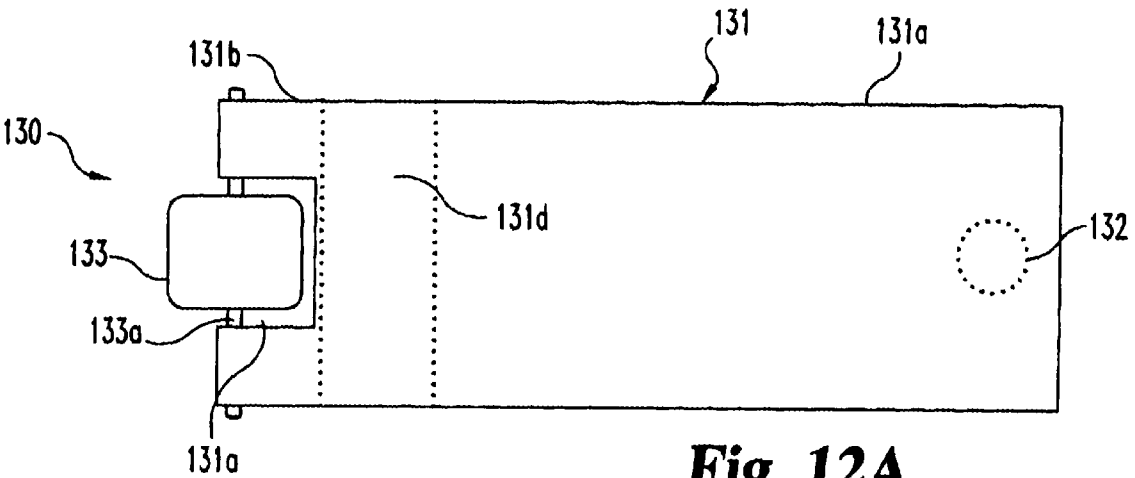
FIG. 12A is a top plan view of a second embodiment of a rocker arm in accordance with the present invention.

Referring to FIGS. 12A and 12B, a second embodiment rocker arm 130 is shown. Rocker arm 130 comprises a body 131, a lash adjuster 132, and a wheel 133. Lash adjuster 132 is disposed within a bottom surface (not shown) of a distal end 131*a* of body 131 and downwardly extended therefrom. Wheel 133 is inserted within a slot 131*c* disposed in an upper portion of a proximal end 131*b* of body 131, and is rotatably adjoined with (preferably detachably coupled to) end 131*b* by a pin 133*a*. A generally cylindrical aperture 131*d* extends through a lower portion of proximal end 131*b* of body 131. Aperture 131*d* is spaced from slot 131*c*.

Embodiments of a valve train in accordance with the present invention will now be described. These embodiments of a valve train are given solely for purposes of describing the best mode of the present invention and are not meant to be limiting to the scope of the claims in any way.

Figure 13A:
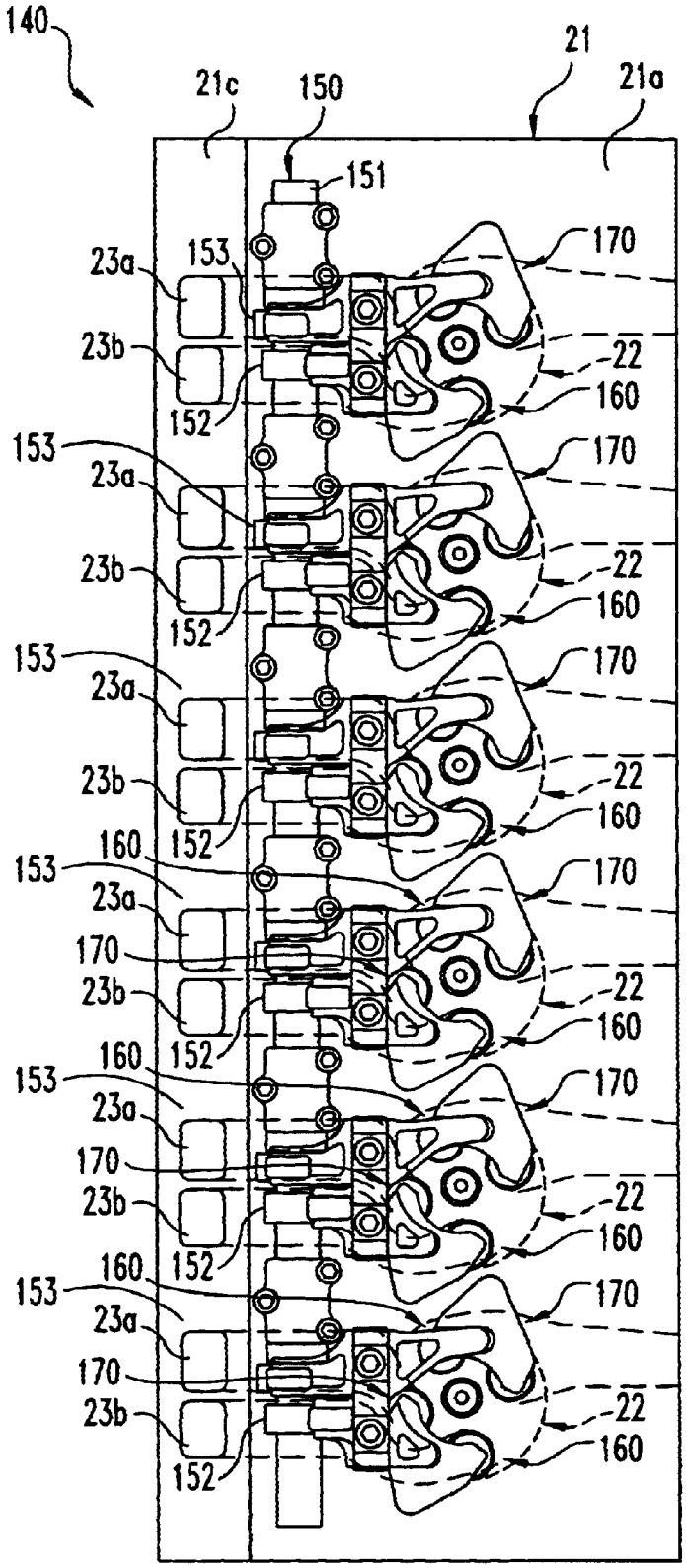
FIG. 13A is a diagrammatic top plan view of a first embodiment of a valve train in accordance with the present invention.
Figure 13B:
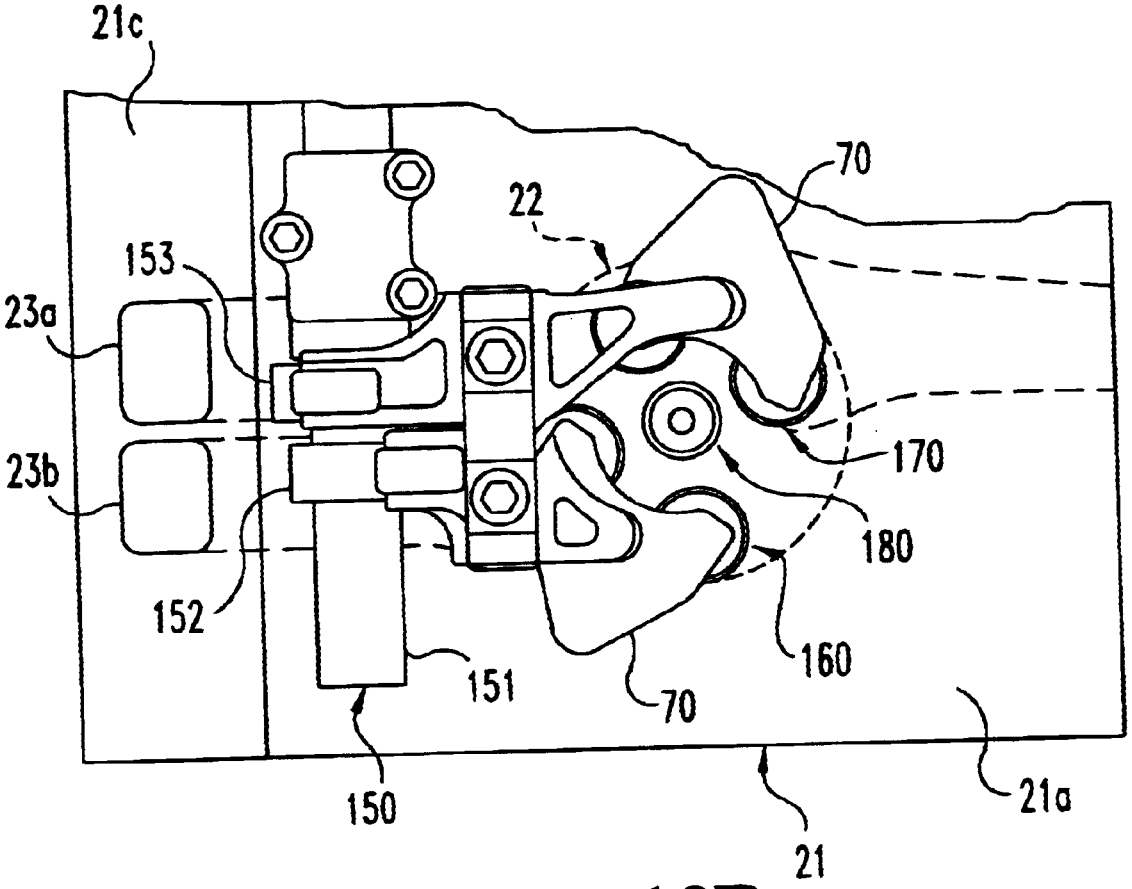
FIG. 13B is an enlarged, partial top plan view of the FIG. 13A valve train.
Figure 13C:
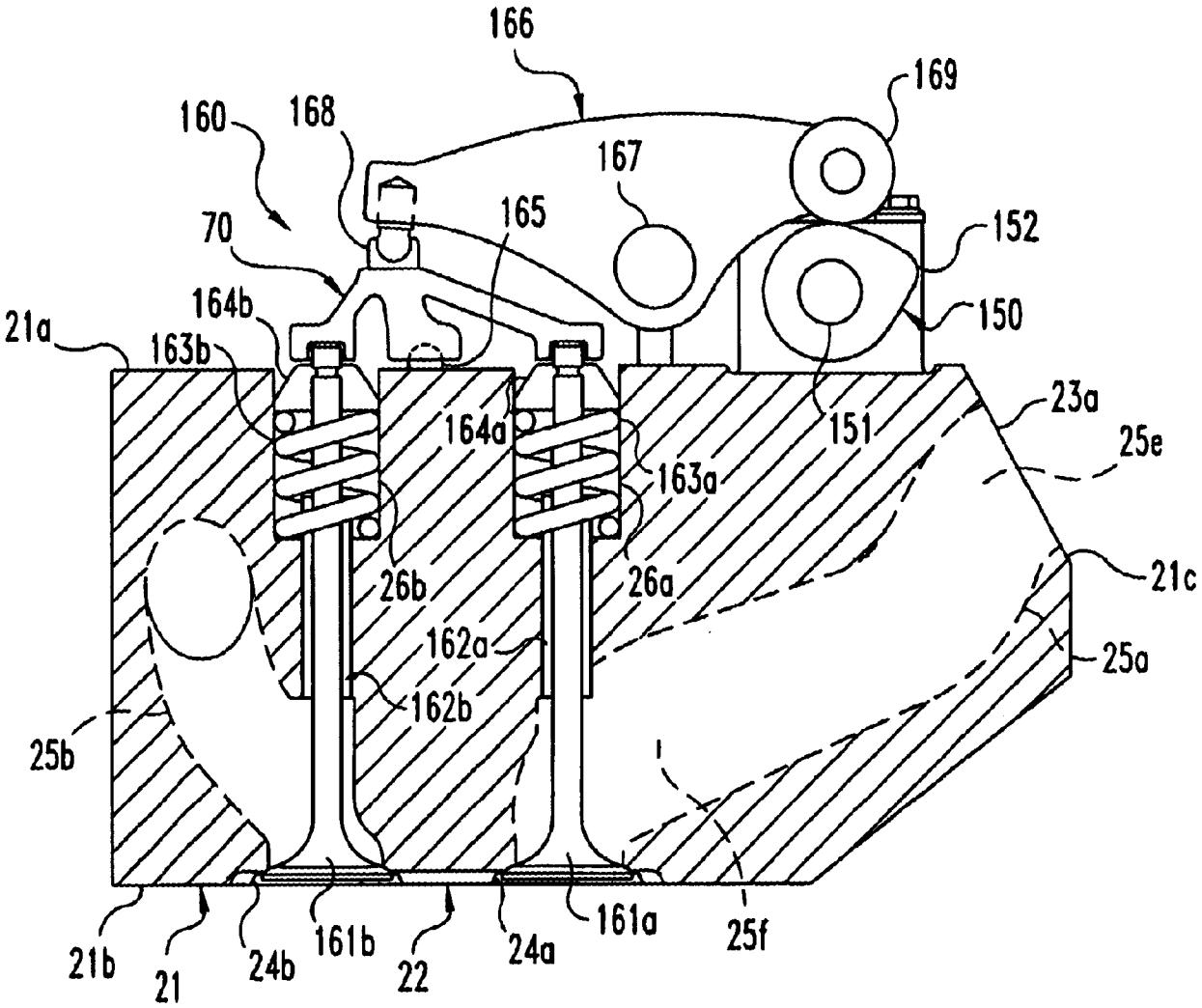
FIG. 13C is a front elevational view in full section of the FIG. 13A valve train.

Referring to FIGS. 13A–13C, a first embodiment valve train 140 is shown. Valve train 140 comprises cylinder head 20 (see FIGS. 1A through 1C), a single camshaft 150, six (6) intake valve assemblies 160, and six (6) exhaust valve assemblies 170. It is to be appreciated that valve train 140 can be constructed to include any number of combustion chamber covers 22, intake valve assemblies 160, and exhaust valve assemblies 170. Camshaft 150 includes a shaft 151 rotatably adjoined to surface 21*a* of body 20. Preferably, shaft 151 is detachably coupled to surface 21*a* of body 21. Shaft 151 is also parallel with the arrangement of combustion chamber covers 22 and spaced therefrom. For each intake valve assembly 160, camshaft 150 further includes an intake cam lobe 152 adjoined to shaft 151. For each exhaust valve assembly 170, camshaft 150 further includes an exhaust cam lobe 153 adjoined to shaft 151. Intake cam lobes 152 and exhaust cam lobes 153 are conventionally configured as shown for a fixed valve timing and lift operation. Preferably, camshaft 150 is fabricated as a unitary member. Alternatively, shaft 151 can be slidably and rotatably adjoined to cylinder head 20, and intake cam lobes 152 and exhaust cam lobes 153 can be configured for a variable valve timing and lift operation. Valve train 140 further comprises a fuel injector 180 for each combustion chamber cover 22. Fuel injectors 180 are inserted within injector bores 28*a* and 28*b* (see FIGS. 1A and 1B). It is to be appreciated that two valve trains 140 or equivalents thereof can be utilized for a conventional "V" engine arrangement.

With continued reference to FIG. 13C, each intake valve assembly 160 includes a pair of intake valves 161*a* and 161*b*. The head of intake valve 161*a* is removably seated within intake valve seat 24*a*, and the head of intake valve 161*b* is removably seated within intake valve seat 24*b*. An intake valve guide 162*a* is fitted within intake bore 26*a*, and an intake valve guide 162*b* is fitted within intake bore 26*b*. The stem of intake valve 161*a* is movably positioned within intake valve guide 162*a*, and the stem of intake valve 161*b* is movably positioned within intake valve guide 162*b*. The head of intake valve 161*a* is upwardly biased as seated within intake valve seat 24*a* by a spring 163*a* positioned within bore 26*a* and secured therein by a spring cap 164*a*. The head of intake valve 161*b* is upwardly biased as seated within intake valve seat 24*b* by a spring 163*b* positioned within bore 26*b* and secured therein by a spring cap 164*b*. The stem top of intake valve 161*a* extends through spring cap 164*a*, and is movably positioned within slot 74*c* of crosshead 70 (see FIGS. 6A through 6D). The stem top of intake valve 161*b* extends through spring cap 164*b*, and is movably positioned within slot 73*c* of crosshead 70 (see FIGS. 6A through 6D). A housing of a lash adjuster 165 is removably seated within intake lash adjuster seat 27*a* (see FIGS. 1A and 1B) and a domed end of lash adjuster 165 is movably positioned within indentation 72*c* of crosshead 70 (see FIGS. 6A through 6D) to thereby pivotally mount crosshead 70 to surface 21*a* of body 21. Each intake valve assembly 160 also includes a rocker arm 166. Rocker arm 166 is a modified version of rocker arm 120 having a different geometric configuration and physical dimensions than the geometric configuration and physical dimensions for rocker arm 120 as shown in FIGS. 11A and 11B. Rocker arm 166 is pivotally adjoined to surface 21*a* of body 21 by a shaft 167 that is detachably coupled to surface 21*a*. An elephant foot 168 of rocker arm 166 abuts planar surface 71*a* of intake crosshead 70 (see FIGS. 6A through 6D) to thereby operatively adjoined rocker arm 166 to intake crosshead 70. A wheel 169 of rocker arm 166 rotatably abuts intake cam lobe 152 to thereby operatively adjoin cam shaft 151 to rocker arm 166. Each exhaust valve assembly 170 includes a pair of exhaust valves similarly disposed within exhaust valves seats 24*c* and 24*d* (see FIG. 1C), a crosshead 70 similarly adjoined to the exhaust valves and surface 21*a*, and a rocker arm similarly adjoined to crosshead 70, surface 21*a*, and cam shaft 151.

Referring to FIGS. 13B and 13C, an exemplary operation of an intake valve assembly 160 will now be described herein. Shaft 151 is rotated by a source of rotational energy, e.g. a crankshaft. Intake cam lobe 152 synchronously rotates with shaft 151. Intake cam lobe 152 cooperatively interacts with wheel 169 of rocker arm 166 so as to pivot rocker arm 166 back and forth about shaft 167. Head 72 of crosshead 70 serves as a fulcrum. Accordingly, when elephant foot 168 of rocker arm 166 is downwardly pivoted, arms 73 and 74 of crosshead 70 exert a downward force on intake valves 161*a* and 161*b*, respectively, that is sufficient to overcome the upward force applied to intake valves 161*a* and 161*b* by springs 164*a* and 164*b*, respectively. As a result, the heads of intake valves 161*a* and 161*b* are unseated from intake valve seats 24*a* and 24*b* to thereby open intake valves 161*a* and 161*b*. Conversely, when elephant foot 168 is upwardly pivoted, the upward force applied to intake valves 161*a* and 161*b* by springs 164*a* and 164*b*, respectively, reseats the heads of intake valves 161*a* and 161*b* within intake valve seats 24*a* and 24*b* to thereby close intake valves 161*a* and 161*b*. It is to be appreciated that exhaust valve assembly 170 operates in a same manner. For each paired inlet valve assembly 160 and exhaust valve assembly 170, it is to preferred that the associated intake cam lobe 152 and outlet cam lobe 153 are uniformly spaced along shaft 151 with the peak lifts thereof being angularly misaligned whereby an opening of intake valves 161*a* and 161*b* partially overlaps with an opening the pair of exhaust valves of the corresponding exhaust valve assembly 170.

Figure 14A:
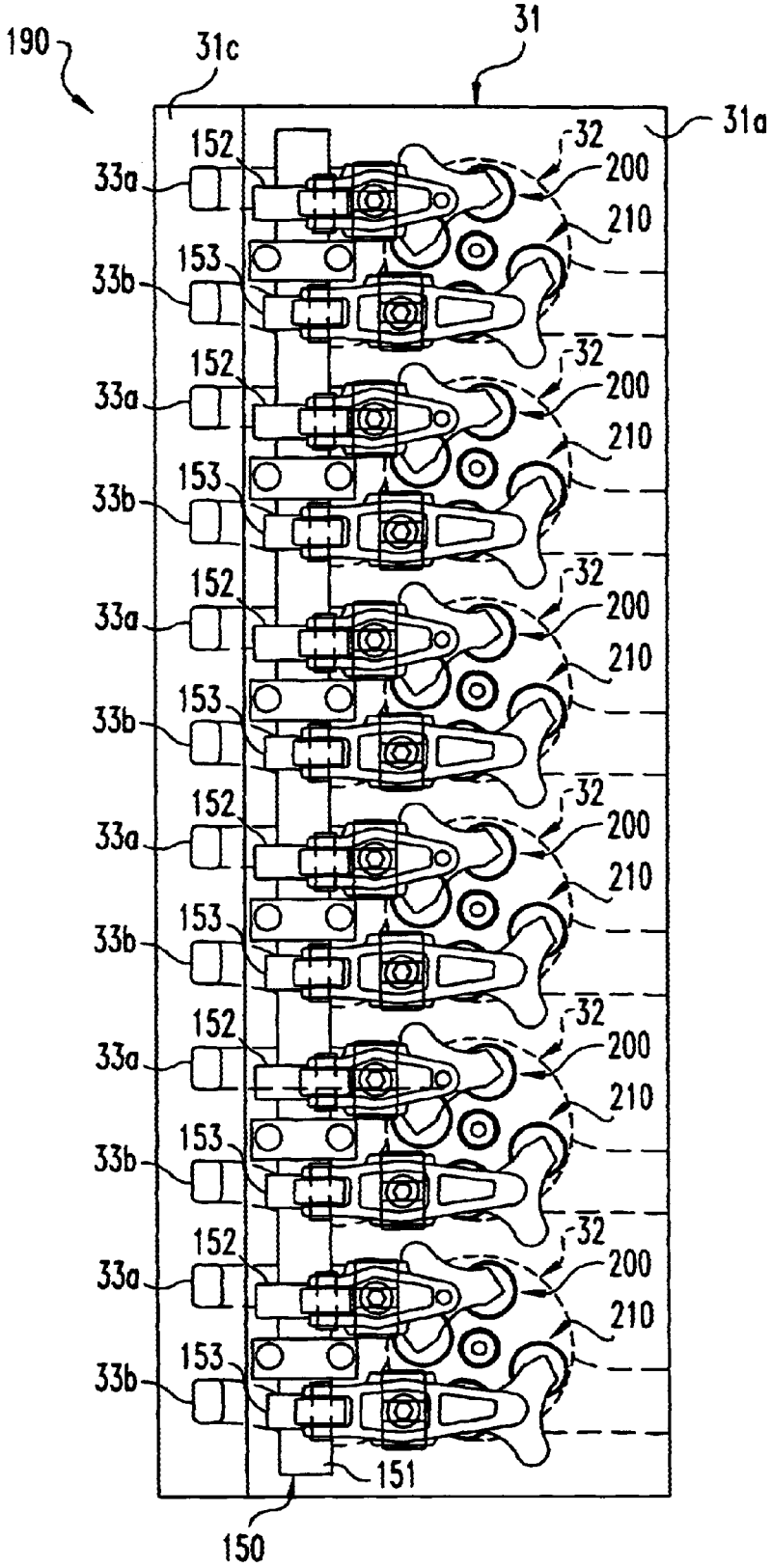
FIG. 14A is a diagrammatic top plan view of a second embodiment of a valve train in accordance with the present invention.
Figure 14B:
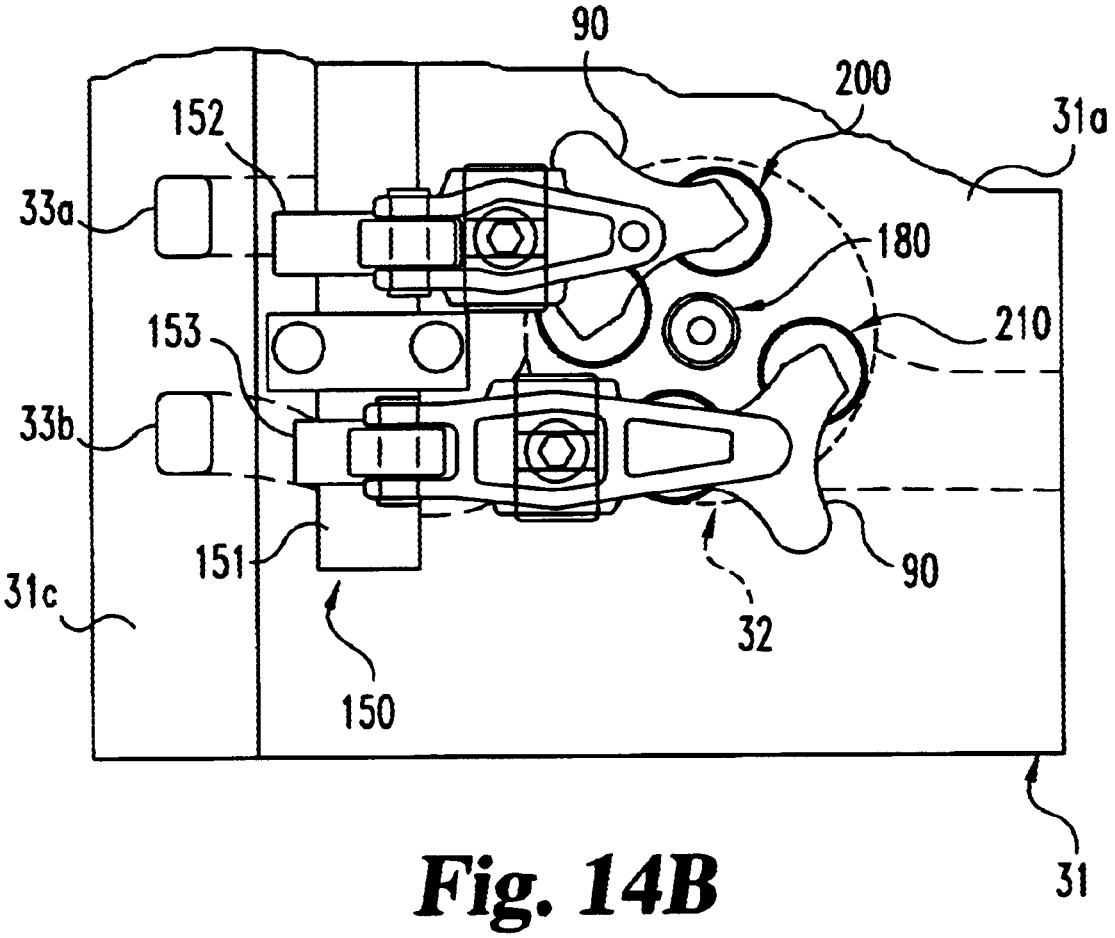
FIG. 14B is an enlarged, partial top plan view of the FIG. 14A valve train.
Figure 14C:
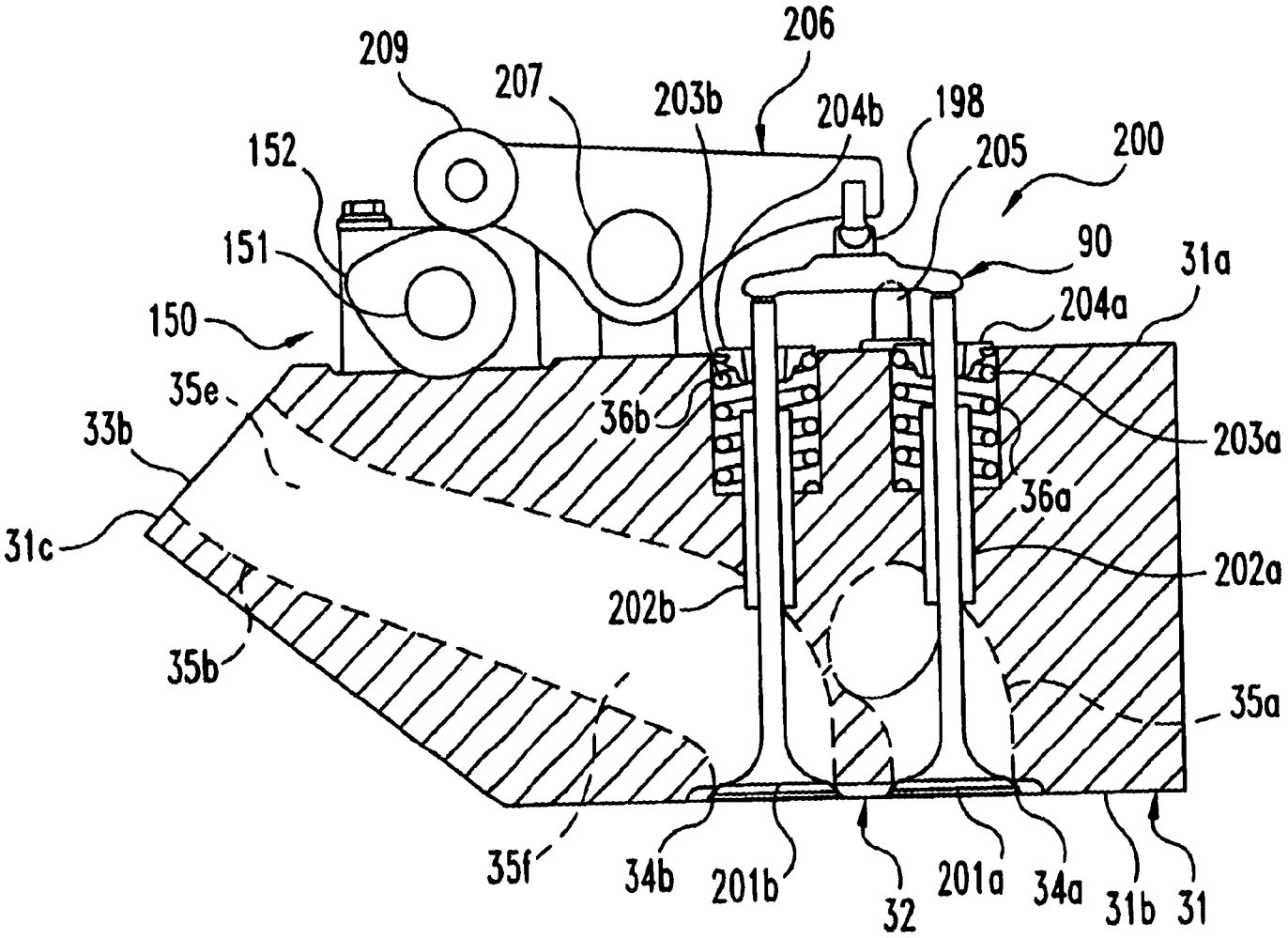
FIG. 14C is a front elevational view in full section of the FIG. 14A valve train.

Referring to FIGS. 14A–14C, a second embodiment valve train 190 is shown. Valve train 190 comprises cylinder head 30 (see FIGS. 2A through 2C), camshaft 150, six (6) intake valve assemblies 200, and six (6) exhaust valve assemblies 210. It is to be appreciated that valve train 190 can be constructed to include any number of combustion chamber covers 32, intake valve assemblies 200, and exhaust valve assemblies 210. Camshaft 150 includes shaft 151 rotatably adjoined to surface 31*a* of body 20. Preferably, shaft 151 is detachably coupled to surface 31*a* of body 31. Shaft 151 is also parallel with the arrangement of combustion chamber covers 32 and spaced therefrom. For each intake valve assembly 200, camshaft 150 further includes an intake cam lobe 152 adjoined to shaft 151. For each exhaust valve assembly 210, camshaft 150 further includes an exhaust cam lobe 153 adjoined to shaft 151. Intake cam lobes 152 and exhaust cam lobes 153 are conventionally configured as shown for a fixed valve timing and lift operation. Preferably, camshaft 150 is again fabricated as a unitary member. Alternatively, shaft 151 can be slidably and rotatably adjoined to cylinder head 30, and intake cam lobes 152 and exhaust cam lobes 153 can be configured for a variable valve timing and lift operation. Valve train 190 further comprises a fuel injector 180 for each combustion chamber cover 32. Fuel injectors 180 are inserted within injector bores 38*a* and 38*b* (see FIGS. 2A and 2B). It is to be appreciated that two valve trains 190 or equivalents thereof can be utilized for a conventional "V" engine arrangement.

With continued reference to FIG. 14C, each intake valve assembly 200 includes a pair of intake valves 201*a* and 201*b*. The head of intake valve 201*a* is removably seated within intake valve seat 34*a*, and the head of intake valve 201*b* is removably seated within intake valve seat 34*b*. An intake valve guide 202*a* is fitted within intake bore 36*a*, and an intake valve guide 202*b* is fitted within intake bore 36*b*. The stem of intake valve 201*a* is movably positioned within intake valve guide 202*a*, and the stem of intake valve 201*b* is movably positioned within intake valve guide 202*b*. The head of intake valve 201*a* is upwardly biased as seated within intake valve seat 34*a* by a spring 203*a* positioned within bore 36*a* and secured therein by a spring cap 204*a*. The head of intake valve 201*b* is upwardly biased as seated within intake valve seat 34*b* by a spring 204*b* positioned within bore 36*b* and secured therein by a spring cap 204*b*. The stem top of intake valve 201*a* extends through spring cap 204*a*, and is movably positioned within slot 94*c* of crosshead 90 (see FIGS. 8A through 8D). The stem top of intake valve 201*b* extends through spring cap 204*b*, and is movably positioned within slot 93*c* of crosshead 90 (see FIGS. 8A through 8D). A housing of a lash adjuster 205 is removably seated within intake lash adjuster seat 37*a* (see FIGS. 2A and 2B) and a domed end of lash adjuster 205 is movably positioned within indentation 92*c* of crosshead 90 (see FIGS. 8A through 8D) to thereby pivotally mount crosshead 90 to surface 31*a* of body 31. Each intake valve assembly 200 also includes a rocker arm 206. Rocker arm 206 is a modified version of rocker arm 120 having a different geometric configuration and physical dimensions than the geometric configuration and physical dimensions for rocker arm 120 as shown in FIGS. 11A and 11B. Rocker arm 206 is pivotally adjoined to surface 31*a* of body 31 by a shaft 207 that is detachably coupled to surface 31*a*. An elephant foot 208 of rocker arm 206 abuts planar surface 91*a* of intake crosshead 90 (see FIGS. 8A through 8D) to thereby operatively adjoined rocker arm 206 to intake crosshead 90. A wheel 209 of rocker arm 206 rotatably abuts intake cam lobe 152 to thereby operatively adjoin cam shaft 151 to rocker arm 206. Each exhaust valve assembly 210 includes a pair of exhaust valves similarly disposed within exhaust valves seats 34*c* and 34*d* (see FIG. 2C), a crosshead 90 similarly adjoined to the exhaust valves and surface 31*a*, and a rocker arm similarly adjoined to crosshead 90, surface 31*a*, and cam shaft 151.

Referring to FIGS. 14B and 14C, an exemplary operation of an intake valve assembly 200 will now be described herein. Shaft 151 is rotated by a source of rotational energy, e.g. a crankshaft. Intake cam lobe 152 synchronously rotates with shaft 151. Intake cam lobe 152 cooperatively interacts with wheel 209 of rocker arm 206 so as to pivot rocker arm 206 back and forth about shaft 207. Head 92 of crosshead 90 serves as a fulcrum. Accordingly, when elephant foot 208 of rocker arm 206 is downwardly pivoted, arms 93 and 94 of crosshead 90 exert a downward force on intake valves 201*a* and 201*b*, respectively, that is sufficient to overcome the upward force applied to intake valves 201*a* and 201*b* by springs 204*a* and 204*b*, respectively. As a result, the heads of intake valves 201*a* and 201*b* are unseated from intake valve seats 34*a* and 34*b* to thereby open intake valves 201*a* and 201*b*. Conversely, when elephant foot 208 is upwardly pivoted, the upward force applied to intake valves 201*a* and 201*b* by springs 204*a* and 204*b*, respectively, reseats the heads of intake valves 201*a* and 201*b* within intake valve seats 34*a* and 34*b* to thereby close intake valves 201*a* and 201*b*. It is to be appreciated that exhaust valve assembly 210 operates in a same manner. For each paired inlet valve assembly 200 and exhaust valve assembly 210, it is preferred that the associated intake cam lobe 152 and outlet cam lobe 153 are uniformly spaced along shaft 151 with the peak lifts thereof being angularly misaligned whereby an opening of intake valves 201*a* and 201*b* partially overlaps with an opening the pair of exhaust valves of the corresponding exhaust valve assembly 210.

Figure 15A:
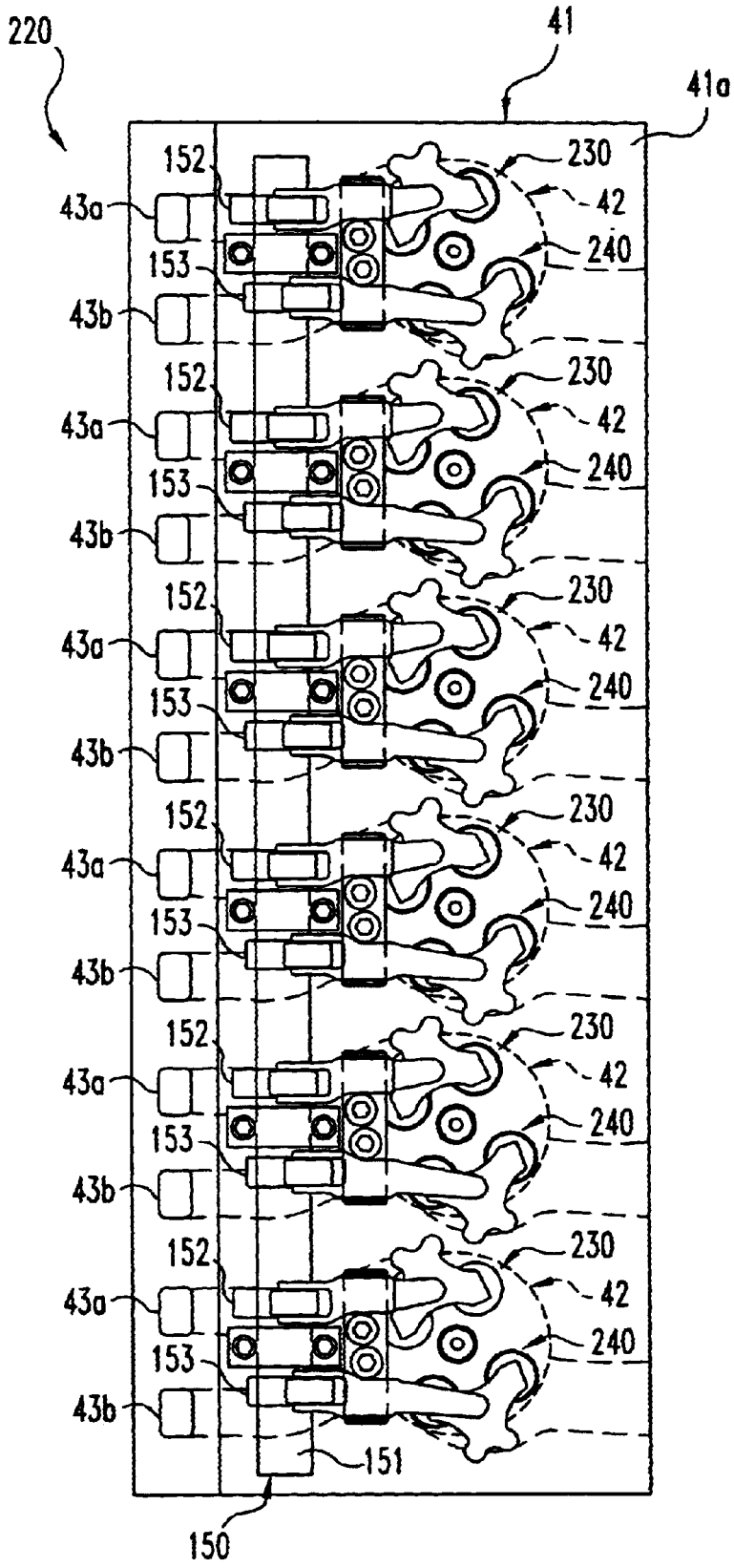
FIG. 15A is a diagrammatic top plan view of a third embodiment of a valve train in accordance with the present invention.
Figure 15B:
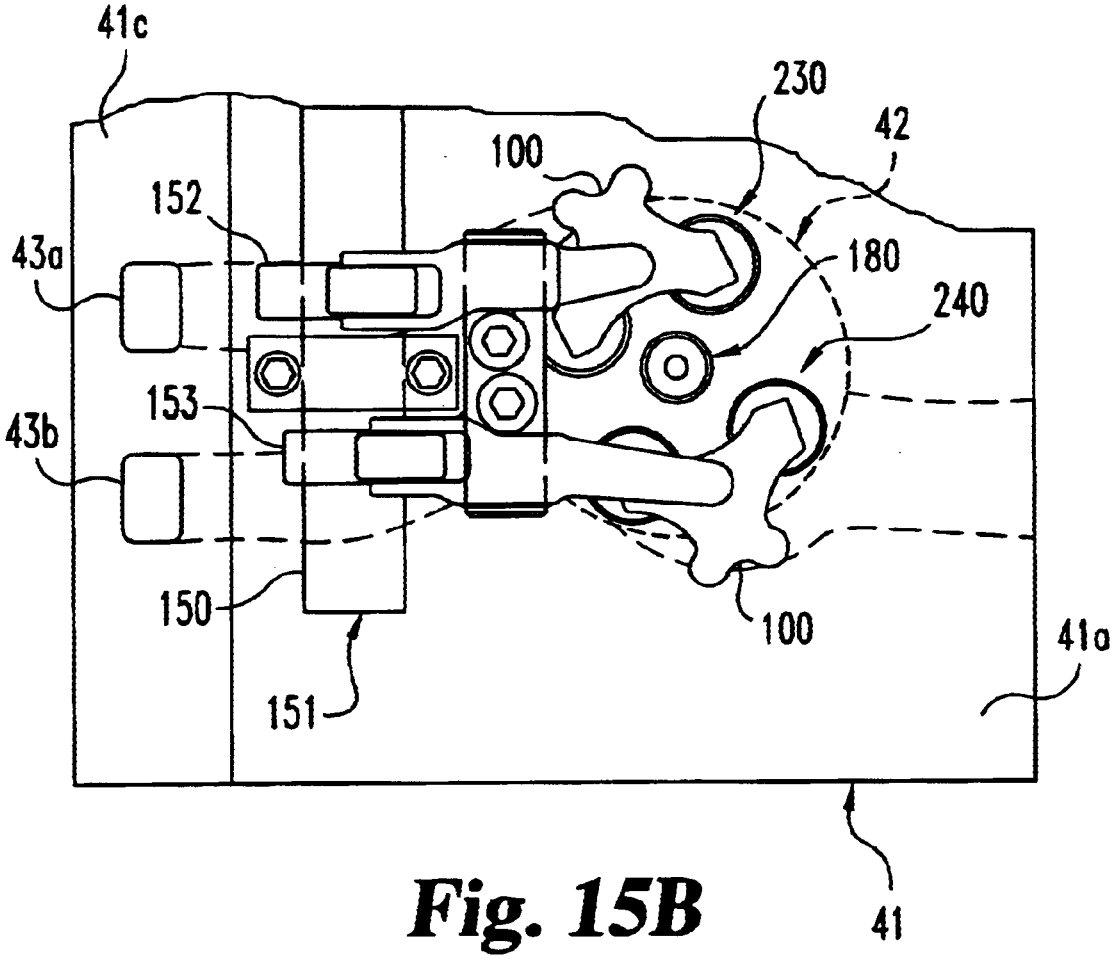
FIG. 15B is an enlarged, partial top plan view of the FIG. 15A valve train.
Figure 15C:
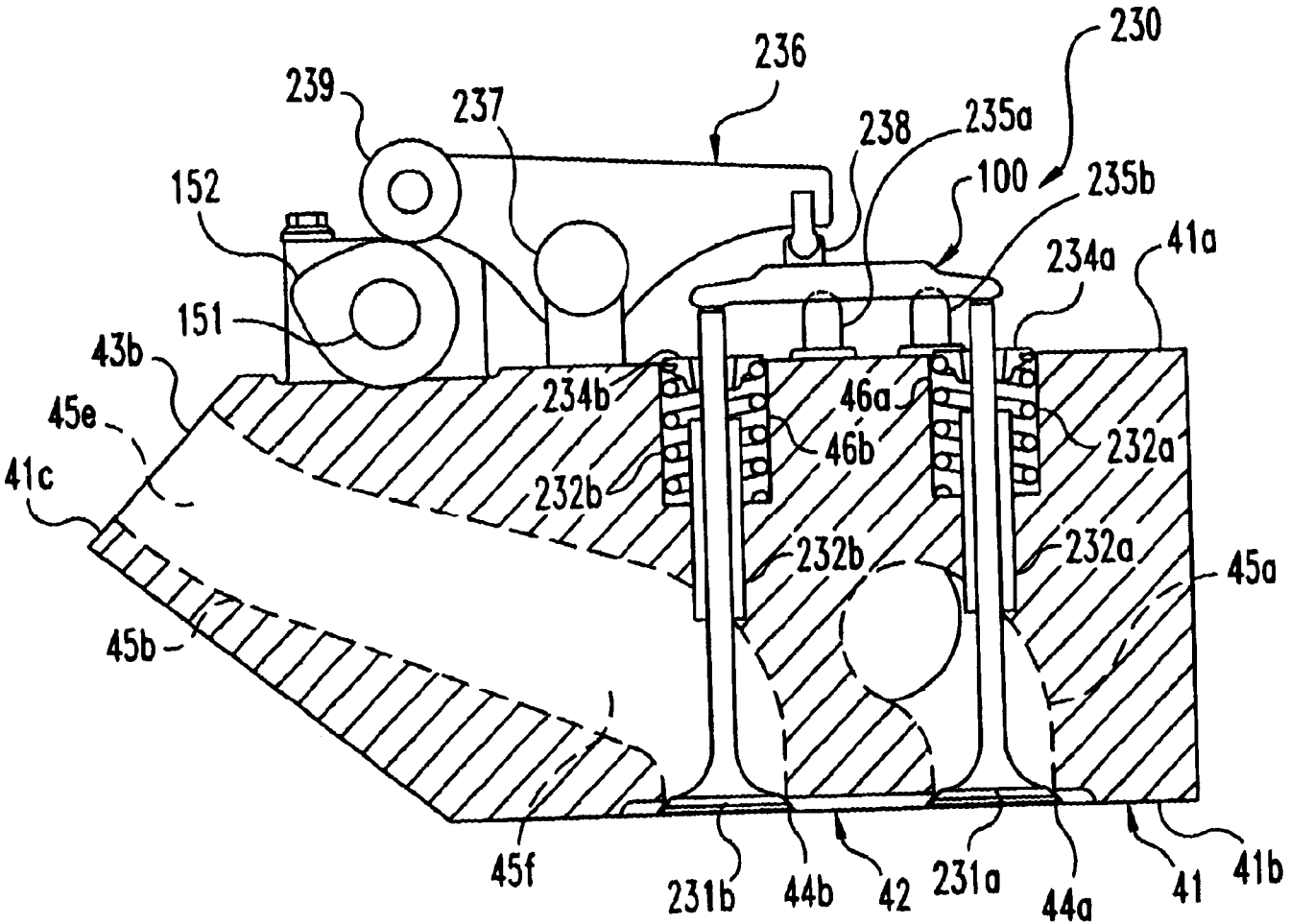
FIG. 15C is a front elevational view in full section of the FIG. 15A valve train.

Referring to FIGS. 15A–15C, a third embodiment valve train 220 is shown. Valve train 220 comprises cylinder head 40 (see FIGS. 3A through 3C), camshaft 150, six (6) intake valve assemblies 230, and six (6) exhaust valve assemblies 240. It is to be appreciated that valve train 220 can be constructed to include any number of combustion chamber covers 42, intake valve assemblies 230, and exhaust valve assemblies 240. Camshaft 150 includes shaft 151 rotatably adjoined to surface 41*a* of body 43. Preferably, shaft 151 is detachably coupled to surface 41*a* of body 41. Shaft 151 is also parallel with the arrangement of combustion chamber covers 42 and spaced therefrom. For each intake valve assembly 230, camshaft 150 further includes an intake cam lobe 152 adjoined to shaft 151. For each exhaust valve assembly 240, camshaft 150 further includes an exhaust cam lobe 153 adjoined to shaft 151. Intake cam lobes 152 and exhaust cam lobes 153 are conventionally configured as shown for a fixed valve timing and lift operation. Preferably, camshaft 150 is again fabricated as a unitary member. Alternatively, shaft 151 can be slidably and rotatably adjoined to cylinder head 40, and intake cam lobes 152 and exhaust cam lobes 153 can be configured for a variable valve timing and lift operation. Valve train 190 further comprises a fuel injector 180 for each combustion chamber cover 42. Fuel injectors 180 are inserted within injector bores 48*a* and 48*b* (see FIGS. 3A and 3B). It is to be appreciated that two valve trains 220 or equivalents thereof can be utilized for a conventional "V" engine arrangement.

With continued reference to FIG. 15C, each intake valve assembly 230 includes a pair of intake valves 231*a* and 231*b*. The head of intake valve 231*a* is removably seated within intake valve seat 44*a*, and the head of intake valve 231*b* is removably seated within intake valve seat 44*b*. An intake valve guide 232*a* is fitted within intake bore 46*a*, and an intake valve guide 232*b* is fitted within intake bore 46*b*. The stem of intake valve 231*a* is movably positioned within intake valve guide 232*a*, and the stem of intake valve 231*b* is movably positioned within intake valve guide 232*b*. The head of intake valve 231*a* is upwardly biased as seated within intake valve seat 44*a* by a spring 233*a* positioned within bore 46*a* and secured therein by a spring cap 234*a*. The head of intake valve 231*b* is upwardly biased as seated within intake valve seat 44*b* by a spring 234*b* positioned within bore 46*b* and secured therein by a spring cap 234*b*. The stem top of intake valve 231*a* extends through spring cap 234*a*, and is movably positioned within slot 105*c* of crosshead 100 (see FIGS. 9A through 9D). The stem top of intake valve 231*b* extends through spring cap 234*b*, and is movably positioned within slot 104*c* of crosshead 100 (see FIGS. 9A through 9D). The housing of a lash adjuster 235*a* is removably seated within intake lash adjuster seat 47*a* (see FIGS. 3A and 3B) and a domed end of lash adjuster 235*a* is movably positioned within indentation 102*c* of crosshead 100 (see FIGS. 9A through 9D). The housing of a lash adjuster 235*b* is removably seated within intake lash adjuster seat 47*b* (see FIGS. 3A and 3B) and a domed end of lash adjuster 235*b* is movably positioned within indentation 103*c* of crosshead 100 (see FIGS. 9A through 9D) to thereby pivotally mount crosshead 100 to surface 41*a* of body 41. Each intake valve assembly 230 also includes a rocker arm 236. Rocker arm 236 is a modified version of rocker arm 120 having a different geometric configuration and physical dimensions than the geometric configuration and physical dimensions for rocker arm 120 as shown in FIGS. 11A and 11B. Rocker arm 236 is pivotally adjoined to surface 41*a* of body 41 by a shaft 237 that is detachably coupled to surface 41*a*. An elephant foot 238 of rocker arm 236 abuts planar surface 101*a* of intake crosshead 100 (see FIGS. 9A through 9D) to thereby operatively adjoined rocker arm 236 to intake crosshead 100. A wheel 239 of rocker arm 236 rotatably abuts intake cam lobe 152 to thereby operatively adjoin cam shaft 151 to rocker arm 236. Each exhaust valve assembly 240 includes a pair of exhaust valves similarly disposed within exhaust valves seats 44*c* and 44*d* (see FIG. 3C), a crosshead 100 similarly adjoined to the exhaust valves and surface 41*a*, and a rocker arm similarly adjoined to crosshead 100, surface 41*a*, and camshaft 151.

Referring to FIGS. 15B and 15C, an exemplary operation of an intake valve assembly 230 will now be described herein. Shaft 151 is rotated by a source of rotational energy, e.g. a crankshaft. Intake cam lobe 152 synchronously rotates with shaft 151. Intake cam lobe 152 cooperatively interacts with wheel 239 of rocker arm 236 so as to pivot rocker arm 236 back and forth about shaft 237. Heads 102 and 103 of crosshead 100 serves as a fulcrum. Accordingly, when elephant foot 238 of rocker arm 236 is downwardly pivoted, arms 104 and 105 of crosshead 100 exert a downward force on intake valves 231*a* and 231*b*, respectively, that is sufficient to overcome the upward force applied to intake valves 231*a* and 231*b* by springs 234*a* and 234*b*, respectively. As a result, the heads of intake valves 231*a* and 231*b* are unseated from intake valve seats 44*a* and 44*b* to thereby open intake valves 231*a* and 231*b*. Conversely, when elephant foot 238 is upwardly pivoted, the upward force applied to intake valves 231*a* and 231*b* by springs 234*a* and 234*b*, respectively, reseats the heads of intake valves 231*a* and 231*b* within intake valve seats 44*a* and 44*b* to thereby close intake valves 231*a* and 231*b*. It is to be appreciated that exhaust valve assembly 240 operates in a same manner. For each paired inlet valve assembly 230 and exhaust valve assembly 240, it is preferred that the associated intake cam lobe 152 and outlet cam lobe 153 are uniformly spaced along shaft 151 with the peak lifts thereof being angularly misaligned whereby an opening of intake valves 231*a* and 231*b* partially overlaps with an opening the pair of exhaust valves of the corresponding exhaust valve assembly 240.

Figure 16A:
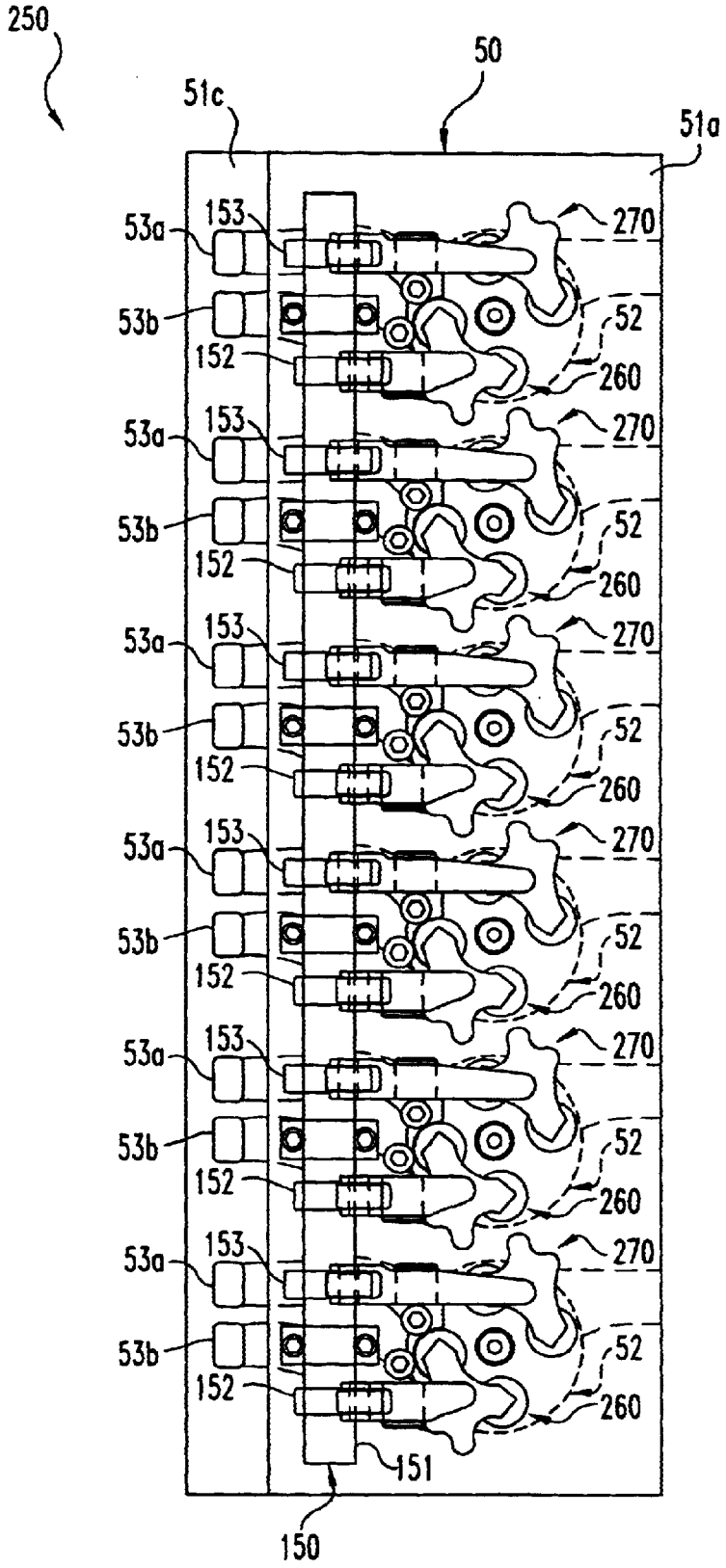
FIG. 16A is a diagrammatic top plan view of a fourth embodiment of a valve train in accordance with the present invention.
Figure 16B:
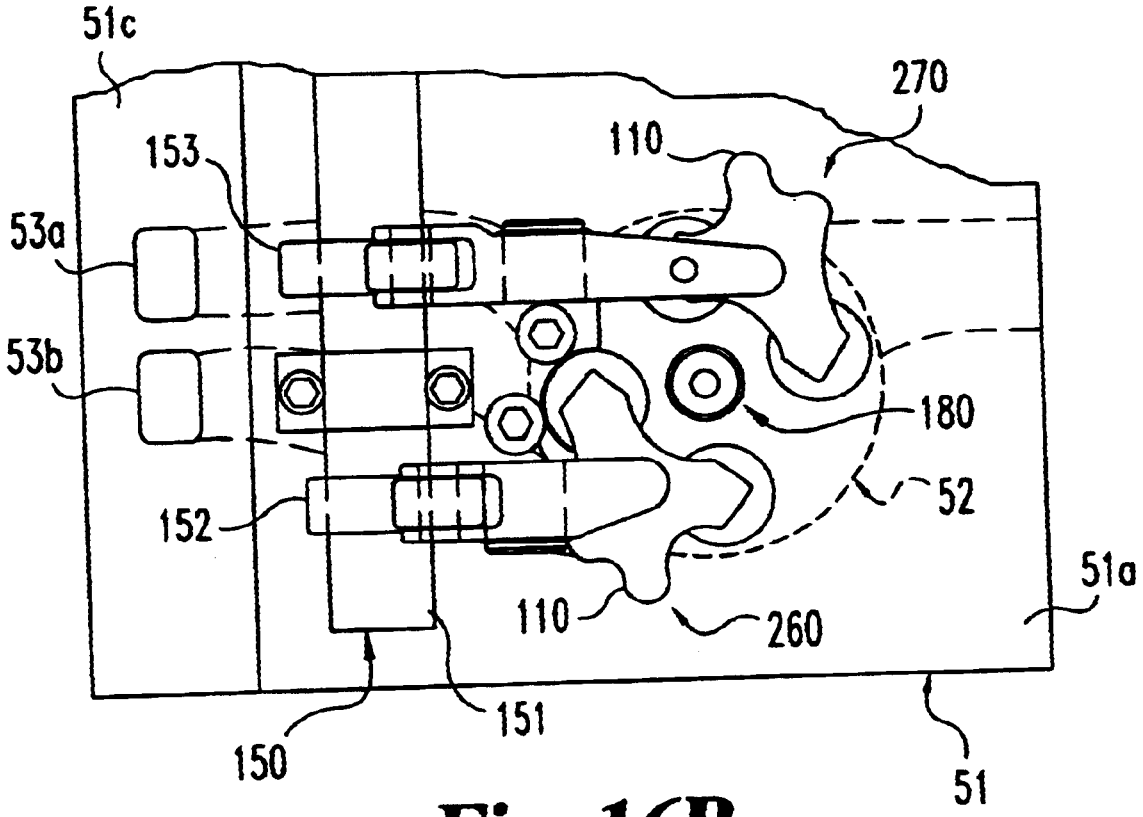
FIG. 16B is an enlarged, partial top plan view of the FIG. 16A valve train.
Figure 16C:
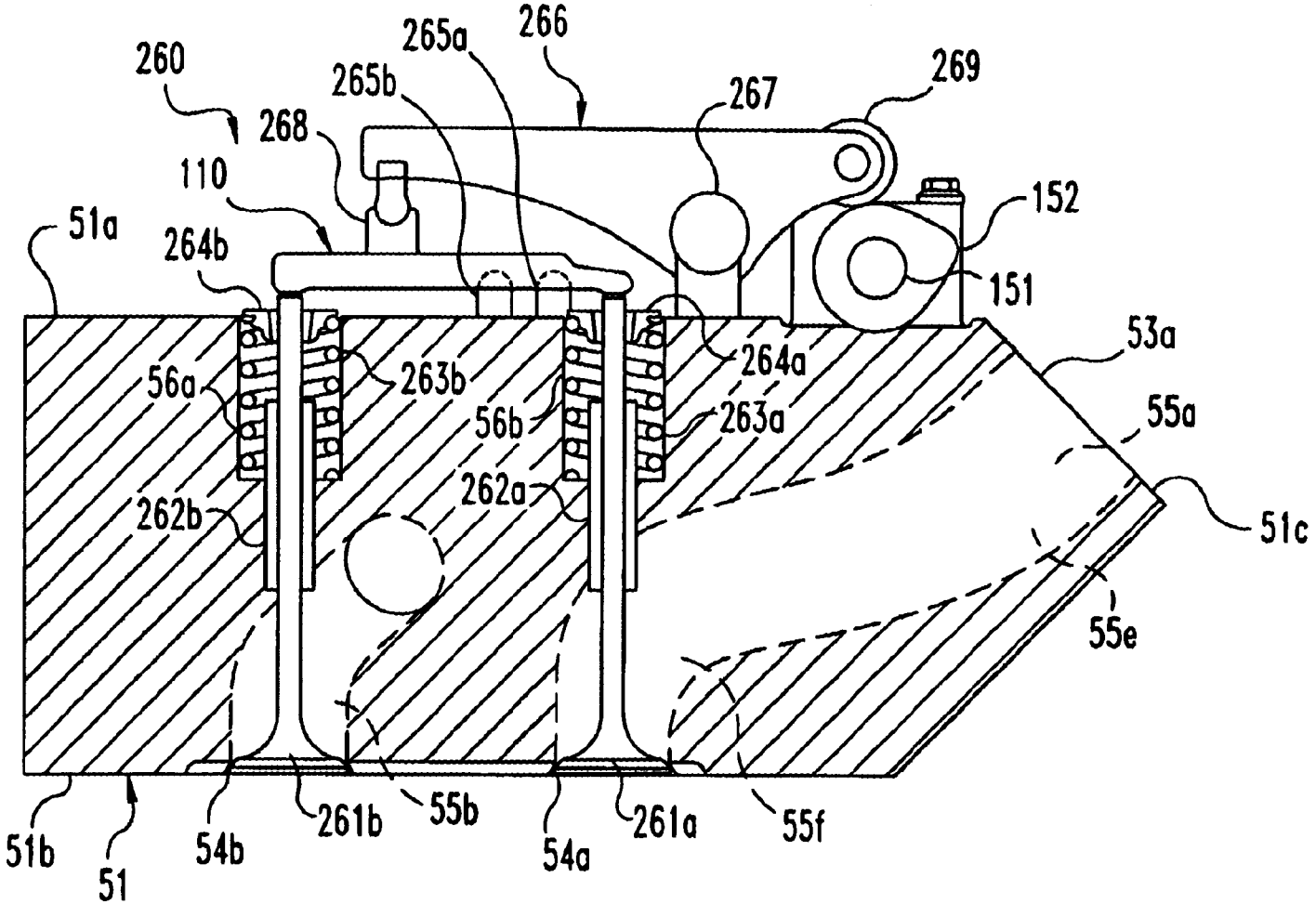
FIG. 16C is a front elevational view in full section of the FIG. 16A valve train.

Referring to FIGS. 16A–16C, a first embodiment valve train 250 is shown. Valve train 250 comprises cylinder head 50 (see FIGS. 4A through 4C), single camshaft 150, six (6) intake valve assemblies 260, and six (6) exhaust valve assemblies 270. It is to be appreciated that valve train 250 can be constructed to include any number of combustion chamber covers 52, intake valve assemblies 260, and exhaust valve assemblies 270. Camshaft 150 includes shaft 151 rotatably adjoined to surface 51*a* of body 53. Preferably, shaft 151 is detachably coupled to surface 51*a* of body 51. Shaft 151 is also parallel with the arrangement of combustion chamber covers 52 and spaced therefrom. For each intake valve assembly 260, camshaft 150 further includes an intake cam lobe 152 adjoined to shaft 151. For each exhaust valve assembly 270, camshaft 150 further includes an exhaust cam lobe 153 adjoined to shaft 151. Intake cam lobes 152 and exhaust cam lobes 153 are conventionally configured as shown for a fixed valve timing and lift operation. Preferably, camshaft 150 is again fabricated as a unitary member. Alternatively, shaft 151 can be slidably and rotatably adjoined to cylinder head 50, and intake cam lobes 152 and exhaust cam lobes 153 can be configured for a variable valve timing and lift operation. Valve train 250 further comprises a fuel injector 180 for each combustion chamber cover 52. Fuel injectors 180 are inserted within injector bores 58*a* and 58*b* (see FIGS. 4A and 4B). It is to be appreciated that two valve trains 250 or equivalents thereof can be utilized for a conventional "V" engine arrangement.

With continued reference to FIG. 16C, each intake valve assembly 260 includes a pair of intake valves 261*a* and 261*b*. The head of intake valve 261*a* is removably seated within intake valve seat 54*a*, and the head of intake valve 261*b* is removably seated within intake valve seat 54*b*. An intake valve guide 262*a* is fitted within intake bore 56*a*, and an intake valve guide 262*b* is fitted within intake bore 56*b*. The stem of intake valve 261*a* is movably positioned within intake valve guide 262*a*, and the stem of intake valve 261*b* is movably positioned within intake valve guide 262*b*. The head of intake valve 261*a* is upwardly biased as seated within intake valve seat 54*a* by a spring 263*a* positioned within bore 56*a* and secured therein by a spring cap 264*a*. The head of intake valve 261*b* is upwardly biased as seated within intake valve seat 54*b* by a spring 264*b* positioned within bore 56*b* and secured therein by a spring cap 264*b*. The stem top of intake valve 261*a* extends through spring cap 264*a*, and is movably positioned within slot 115*c* of crosshead 110 (see FIGS. 10A through 10D). The stem top of intake valve 261*b* extends through spring cap 264*b*, and is movably positioned within slot 114*c* of crosshead 110 (see FIGS. 10A through 10D). The housing of a lash adjuster 265*a* is removably seated within intake lash adjuster seat 57*a* (see FIGS. 4A and 4B) and a domed end of lash adjuster 265*a* is movably positioned within indentation 113*c* of crosshead 110 (see FIGS. 10A through 10D). The housing of a lash adjuster 265*b* is removably seated within intake lash adjuster seat 57*b* (see FIGS. 4A and 4B) and a domed end of lash adjuster 265*b* is movably positioned within indentation 112*c* of crosshead 110 (see FIGS. 10A through 10C) to thereby pivotally mount crosshead 110 to surface 51*a* of body 51. Each intake valve assembly 260 also includes a rocker arm 266. Rocker arm 266 is a modified version of rocker arm 120 having a different geometric configuration and physical dimensions than the geometric configuration and physical dimensions for rocker arm 120 as shown in FIGS. 11A and 11B. Rocker arm 266 is pivotally adjoined to surface 51*a* of body 51 by a shaft 267 that is detachably coupled to surface 51*a*. An elephant foot 268 of rocker arm 266 abuts planar surface 11*a* of intake crosshead 110 (see FIGS. 10A through 10D) to thereby operatively adjoined rocker arm 266 to intake crosshead 110. A wheel 269 of rocker arm 266 rotatably abuts intake cam lobe 152 to thereby operatively adjoin cam shaft 151 to rocker arm 266. Each exhaust valve assembly 270 includes a pair of exhaust valves similarly disposed within exhaust valves seats 54*c* and 54*d* (see FIG. 4C), a crosshead 110 similarly adjoined to the exhaust valves and surface 51*a*, and a rocker arm similarly adjoined to crosshead 110, surface 51*a*, and cam shaft 151.

Referring to FIGS. 16B and 16C, an exemplary operation of an intake valve assembly 260 will now be described herein. Shaft 151 is rotated by a source of rotational energy, e.g. a crankshaft. Intake cam lobe 152 synchronously rotates with shaft 151. Intake cam lobe 152 cooperatively interacts with wheel 269 of rocker arm 266 so as to pivot rocker arm 266 back and forth about shaft 267. Heads 112 and 113 of crosshead 110 serve as a fulcrum. Accordingly, when elephant foot 268 of rocker arm 266 is downwardly pivoted, arms 114 and 115 of crosshead 110 exert a downward force on intake valves 261*a* and 261*b*, respectively, that is sufficient to overcome the upward force applied to intake valves 261*a* and 261*b* by springs 264*a* and 264*b*, respectively. As a result, the heads of intake valves 261*a* and 261*b* are unseated from intake valve seats 54*a* and 54*b* to thereby open intake valves 261*a* and 261*b*. Conversely, when elephant foot 268 is upwardly pivoted, the upward force applied to intake valves 261*a* and 261*b* by springs 264*a* and 264*b*, respectively, reseats the heads of intake valves 261*a* and 261*b* within intake valve seats 54*a* and 54*b* to thereby close intake valves 261*a* and 261*b*. It is to be appreciated that exhaust valve assembly 270 operates in a same manner. For each paired inlet valve assembly 260 and exhaust valve assembly 270, it is preferred that the associated intake cam lobe 152 and outlet cam lobe 153 are uniformly spaced along shaft 151 with the peak lifts thereof being angularly misaligned whereby an opening of intake valves 261*a* and 261*b* does not overlap with an opening the pair of exhaust valves of the corresponding exhaust valve assembly 270.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An internal combustion engine valve train, comprising:

an internal combustion engine cylinder head having a first side with a plurality of combustion surfaces and a second side spaced from said first side, said cylinder head including a plurality of valve receiving bores formed between said first side and said second side and proximate each of said plurality of combustion surfaces, each of said valve receiving bores includes a valve seat in said first side;

a plurality of valves having a head end and a stem end and a stem member extending therebetween, each of said valve receiving bores having one of said plurality of valves moveable therein with said stem member moveably positioned within a portion of said valve receiving bore and said head end removably seated within said valve seat;

a plurality of crossheads, each of said crossheads having a plurality of valve receiving arms and a lash adjuster receiving arm; and a plurality of lash adjusters on said second side of the cylinder head, each of said plurality of lash adjuster receiving arms in contact with one of said plurality of lash adjusters and each of said valve receiving arms in contact with the stem end of one of said plurality of valves.

2. The valve train of claim 1, wherein each of said plurality of lash adjusters automatically compensates for clearance in a portion of the valve train.

3. The valve train of claim 1, which further includes a plurality of rocker arms pivotally coupled to said cylinder head, and wherein each of said plurality of rocker arms include a crosshead engagement surface disposed in contact with one of said plurality of crossheads.

4. The valve train of claim 1, wherein said plurality of valve receiving bores defines a pair of intake valve receiving bores proximate each of said plurality of combustion chambers;

wherein said plurality of valves define a plurality of intake valves;

wherein each of said plurality of valve receiving arms defines a pair of intake valve receiving arms; and wherein each of said crossheads contacts one of said lash adjusters through said lash adjuster arm and contacts a pair of said intake valves through said pair of intake valve receiving arms.

5. The valve train of claim 1, wherein said plurality of valve receiving bores defines a pair of exhaust valve receiving bores proximate each of said plurality of combustion chambers;

wherein said plurality of valves define a plurality of exhaust valves;

wherein each of said plurality of valve receiving arms defines a pair of exhaust valve receiving arms; and wherein each of said crossheads contacts one of said lash adjusters through said lash adjuster arm and contacts a pair of said exhaust valves through said pair of exhaust valve receiving arms.

6. The valve train of claim 1, wherein said cylinder head includes a plurality of second valve receiving bores formed between said first side and said second side and proximate each of said plurality of combustion surfaces, each of said second valve receiving bores includes a second valve seat in said first side;

a plurality of second valves having a second head end and a second stem end and a second stem member extending therebetween, each of said second valve receiving bores having one of said plurality of second valves moveable therein with said second stem member moveably positioned within a portion of said second valve receiving bore, and said second head end removably seated within said second valve seat;

a plurality of second crossheads, each of said second crossheads having a plurality of second valve receiving arms and a second lash adjuster receiving arm; and a plurality of second lash adjusters on said second side of the cylinder head, each of said plurality of second lash adjuster receiving arms in contact with one of said plurality of second lash adjusters and each of said second valve receiving arms in contact with the second stem end of one of said plurality of second valves.

7. The valve train of claim 6, wherein said plurality of valve receiving bores defines a pair of intake valve receiving bores proximate each of said plurality of combustion chambers;

wherein said plurality of valves define a plurality of intake valves;

wherein each of said plurality of valve receiving arms defines a pair of intake valve receiving arms;

wherein each of said crossheads contacts one of said lash adjusters through said lash adjuster arm and contacts a pair of said intake valves through said pair of intake valve receiving arms;

wherein said plurality of second valve receiving bores defines a pair of exhaust valve receiving bores proximate each of said plurality of combustion chambers;

wherein said plurality of second valves define a plurality of exhaust valves;

wherein each of said plurality of second valve receiving arms defines a pair of exhaust valve receiving arms; and wherein each of said second crossheads contacts one of said second lash adjusters through said second lash adjuster arm and contacts a pair of said exhaust valves through said pair of exhaust valve receiving arms.

8. An internal combustion engine valve train, comprising:

an internal combustion engine cylinder head having a first side with a plurality of combustion surfaces and a second side spaced from said first side, said cylinder head including a plurality of valve receiving bores formed between said first side and said second side and proximate each of said plurality of combustion surfaces, each of said valve receiving bores includes a valve seat in said first side;

a plurality of valves having a head end and a stem end and a stem member extending therebetween, each of said valve receiving bores having one of said plurality of valves moveable therein with said stem member moveably positioned within a portion of said valve receiving bore and said head end removably seated within said valve seat;

a plurality of crossheads, each of said crossheads having a plurality of valve receiving arms and a lash adjuster receiving arm; and a plurality of lash adjusters on said second side of the cylinder head; and means for coupling said lash adjusters with said stem end of said valves located proximate each of said combustion surfaces.

9. The valve train of claim 8, wherein said lash adjusters are adapted to compensate for mechanical clearance in the valve train.

* * * * *

UNITED STATES PATENT AND TRADEMARK OFFICE

CERTIFICATE OF CORRECTION

PATENT NO. : 6,659,056 B2
DATED : December 9, 2003
INVENTOR(S) : Roger D. Sweetland It is certified that error appears in the above-identified patent and that said Letters Patent is hereby corrected as shown below:

Column 1,
Line 2, please insert the following paragraph:
-- This invention was made with Government support under Contract No. DEFC05970R22533 awarded by the United States Department of Energy. The Department of Energy has certain rights in this invention. --

Signed and Sealed this

Twenty-fourth Day of February, 2004

JON W. DUDAS
*Acting Director of the United States Patent and Trademark Office*